US005606408A

United States Patent [19]

Yano et al.

[11] Patent Number: 5,606,408

[45] Date of Patent: Feb. 25, 1997

[54] IMAGE FORMING APPARATUS AND CLEANING DEVICE THEREFOR

[75] Inventors: Hidetoshi Yano, Yokohama; Hisashi Shoji, Kawasaki; Tsukuru Kai, Fujisawa; Osamu Endo, Kawasaki; Yoshiko Ishii, Tsukuba; Nobuto Yokokawa, Gotenba; Masako Suzuki, Yokohama; Yukiko Iwasaki, Tokyo; Koji Sakamoto, Tokyo; Yasushi Nakazato, Tokyo; Takayuki Kimura, Yokohama, all of Japan

[73] Assignee: Ricoh Company, Ltd., Tokyo, Japan

[21] Appl. No.: 536,205

[22] Filed: Sep. 29, 1995

[30] Foreign Application Priority Data

| | | | |
|---|---|---|---|
| Sep. 30, 1994 | [JP] | Japan | 6-261949 |
| Nov. 15, 1994 | [JP] | Japan | 6-280720 |
| Nov. 15, 1994 | [JP] | Japan | 6-280721 |
| Nov. 15, 1994 | [JP] | Japan | 6-280722 |
| Nov. 16, 1994 | [JP] | Japan | 6-281949 |
| Feb. 3, 1995 | [JP] | Japan | 7-017216 |
| Mar. 24, 1995 | [JP] | Japan | 7-066246 |
| Mar. 28, 1995 | [JP] | Japan | 7-069125 |
| May 31, 1995 | [JP] | Japan | 7-134099 |
| Sep. 14, 1995 | [JP] | Japan | 7-262138 |

[51] Int. Cl.[6] ..... G03G 21/00

[52] U.S. Cl. ..... 399/343; 399/354

[58] Field of Search ..... 355/215, 296, 355/298, 301, 303, 270

[56] References Cited

U.S. PATENT DOCUMENTS

| | | | |
|---|---|---|---|
| 4,319,832 | 3/1982 | Sakamoto et al. . | |
| 4,412,736 | 11/1983 | Sakamoto et al. . | |
| 4,530,596 | 7/1985 | Kawamoto et al. | 355/303 |
| 4,693,586 | 9/1987 | Sumida et al. . | |
| 4,772,253 | 9/1988 | Koizumi et al. . | |
| 4,791,455 | 12/1988 | Yamamoto et al. | 355/303 |
| 4,956,677 | 9/1990 | Akiyama | 355/303 |
| 4,969,010 | 11/1990 | Tamura et al. . | |
| 5,124,757 | 6/1992 | Ikegawa | 355/296 |
| 5,231,456 | 7/1993 | Kikuchi et al. | 355/270 |
| 5,235,384 | 8/1993 | Oka et al. . | |
| 5,260,754 | 11/1993 | Yano et al. . | |
| 5,282,007 | 1/1994 | Oshiumi | 355/296 |
| 5,291,256 | 3/1994 | Kitajima et al. . | |
| 5,333,041 | 7/1994 | Ito et al. . | |
| 5,442,430 | 8/1995 | Ishii et al. . | |

FOREIGN PATENT DOCUMENTS

| | | |
|---|---|---|
| 0575159 | 12/1993 | European Pat. Off. . |
| 2217260 | 10/1989 | United Kingdom . |

*Primary Examiner*—Sandra L. Brase

*Attorney, Agent, or Firm*—Oblon, Spivak, McClelland, Maier & Neustadt, P.C.

[57] ABSTRACT

In an image forming apparatus, during the course of recording, a cleaning roller is rotated together with an image carrier. The roller frictionally charges toner left on the image carrier after image transfer to the same polarity. A cleaning member electrostatically collects the charged toner. At the same time, a voltage is applied to the cleaning member by a voltage applying device in order to cause it to attract the charged toner, thereby cleaning the image carrier. Hence, even when the toner remaining on image carrier is charged partly to the positive polarity and partly to the negative polarity, the toner can be entirely transferred to the cleaning member by a simple construction.

35 Claims, 31 Drawing Sheets

CHARGING SYSTEM

DEVELOPING SYSTEM

IMAGE TRANSFERRING SYSTEM

CLEANING SYSTEM

DISCHARGING SYSTEM

DRUM ROTATION

CHARGE ROLLER

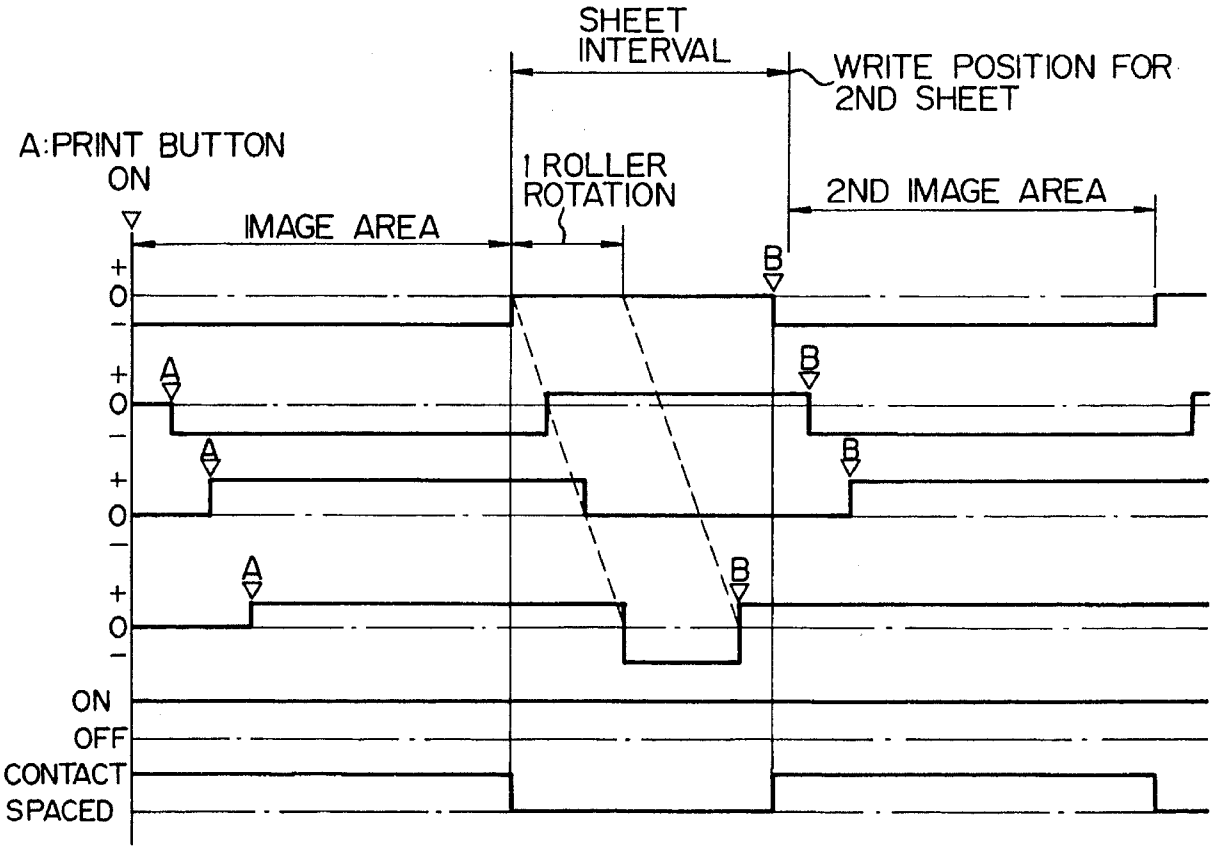
Fig. 11A CHARGING SYSTEM
Fig. 11B DEVELOPING SYSTEM
Fig. 11C IMAGE TRANSFERRING SYSTEM
Fig. 11D CLEANING SYSTEM
Fig. 11E DISCHARGING SYSTEM
Fig. 11F CHARGE ROLLER

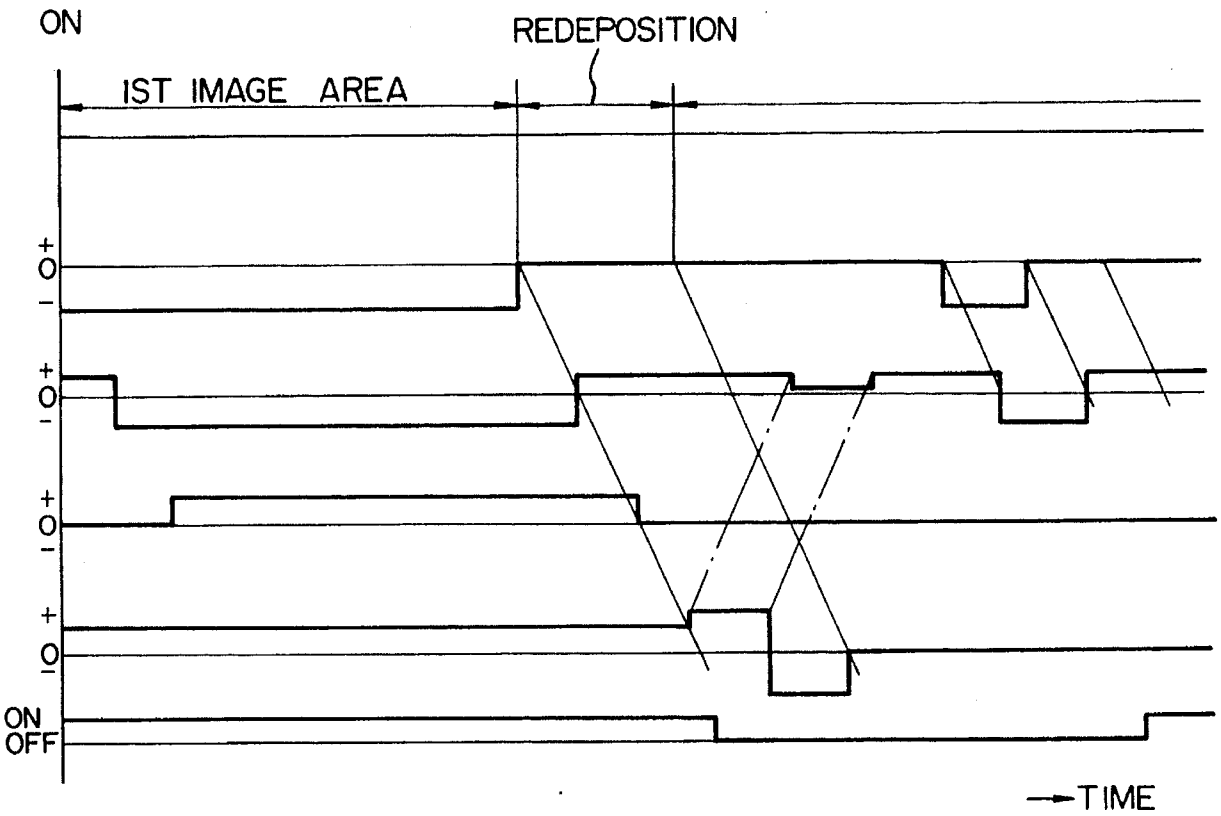
Fig. 12A CHARGING SYSTEM
Fig. 12B DEVELOPING SYSTEM
Fig. 12C IMAGE TRANSFERRING SYSTEM
Fig. 12D CLEANING SYSTEM
Fig. 12E DISCHARGING SYSTEM

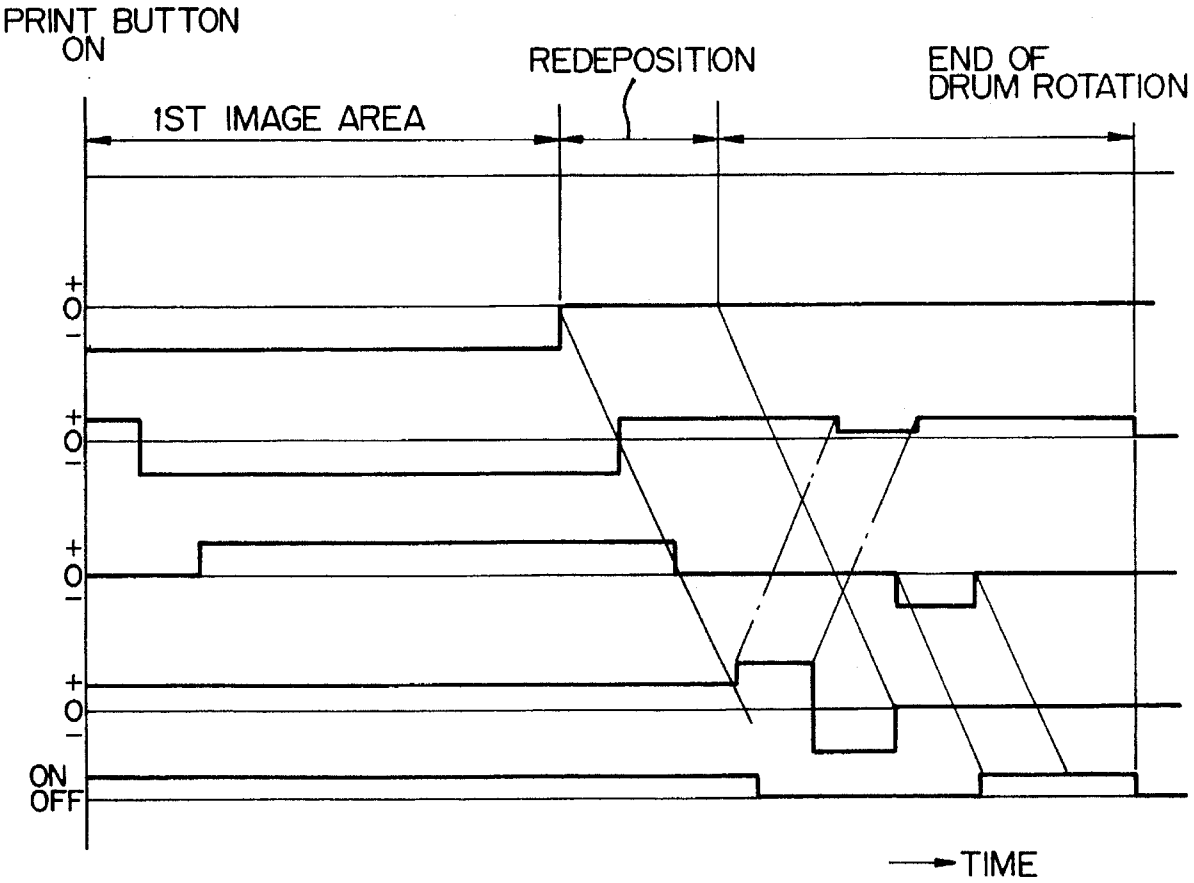
Fig. 13A DISCHARGING SYSTEM
Fig. 13B DEVELOPING SYSTEM
Fig. 13C IMAGE TRANSFERRING SYSTEM
Fig. 13D CLEANING SYSTEM
Fig. 13E DISCHARGING SYSTEM

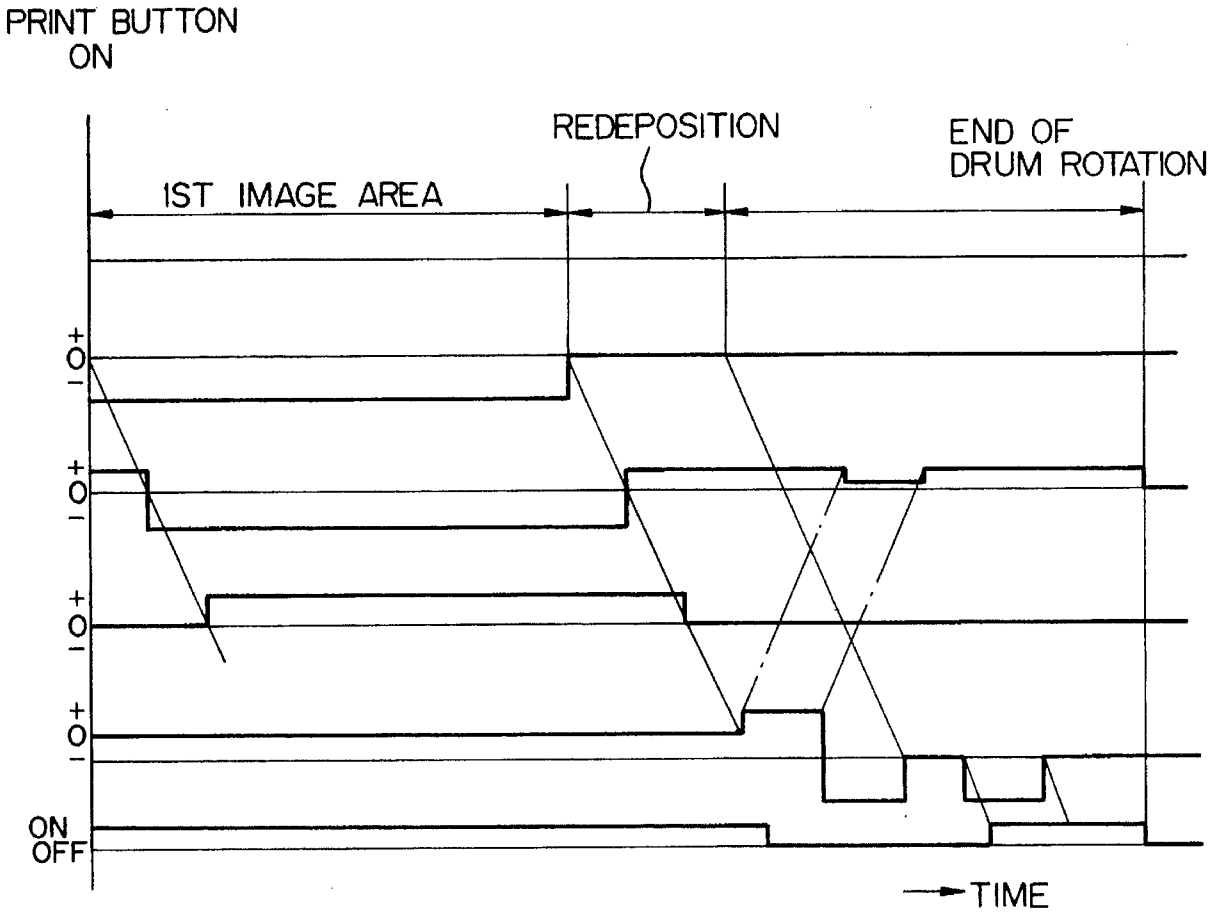
Fig. 14A DISCHARGING SYSTEM
Fig. 14B DEVELOPING SYSTEM
Fig. 14C IMAGE TRANSFERRING SYSTEM
Fig. 14D CLEANING SYSTEM
Fig. 14E DISCHARGING SYSTEM

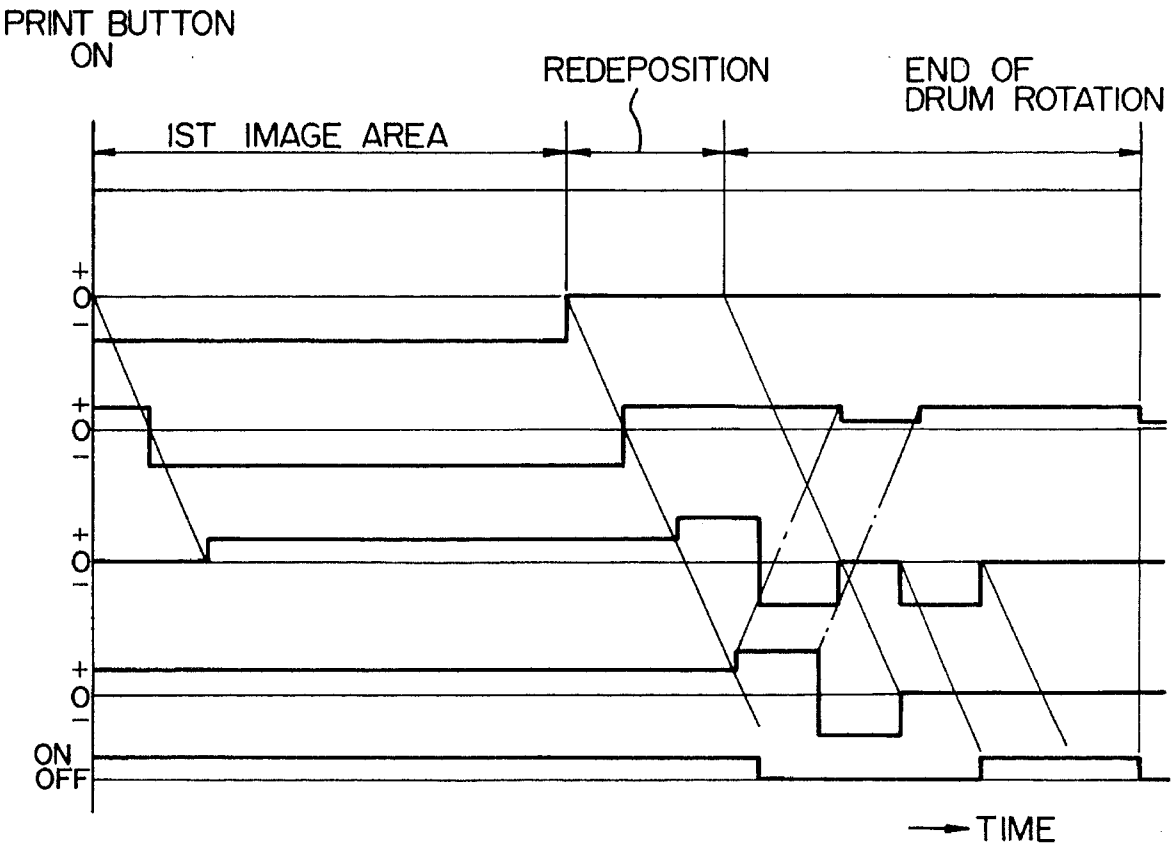
Fig. 15A CHARGING SYSTEM
Fig. 15B DEVELOPING SYSTEM
Fig. 15C IMAGE TRANSFERRING SYSTEM
Fig. 15D CLEANING SYSTEM
Fig. 15E DISCHARGING SYSTEM

PRINT BUTTON ON
1 ROLLER ROTATION
STOP OF DRUM
1ST IMAGE AREA

CHARGING SYSTEM

DEVELOPING SYSTEN

IMAGE TRANSFERRING SYSTEM

CLEANING SYSTEM

DISCHARGING SYSTEM

CLEANING ROLLER

CHARGE ROLLER
+
0
−
ON
OFF
CONTACT
SPACED
CONTACT
SPACED

PRINT BUTTON ON
1 ROLLER ROTATION
STOP OF DRUM
1ST IMAGE AREA

CHARGING SYSTEM

DEVELOPING SYSTEM

IMAGE TRANSFERRING SYSTEM

CLEANING SYSTEM

DISCHARGING SYSTEM

CLEANING ROLLER

CHARGE ROLLER
+
O
-
ON
OFF
CONTACT
SPACED
CONTACT
SPACED

PRINT BUTTON ON
1 ROLLER ROTATION
STOP OF DRUM
1ST IMAGE AREA

CHARGING SYSTEM

DEVELOPING SYSTEM

IMAGE TRANSFERRING SYSTEM

CLEANING SYSTEM

DISCHARGING SYSTEM

CLEANING ROLLER

CHARGE ROLLER
+
0
−
ON
OFF
CONTACT
SPACED
CONTACT
SPACED

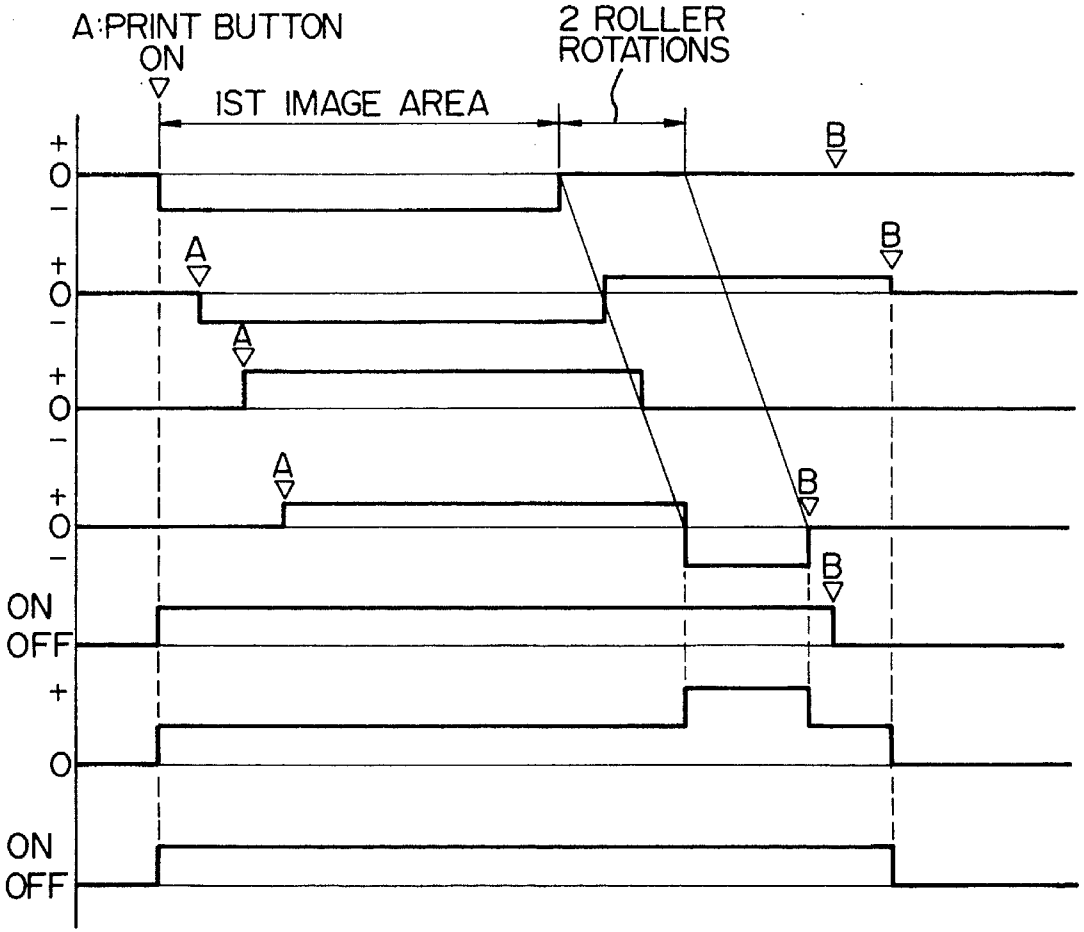
Fig. 26A CHARGING SYSTEM
Fig. 26B DEVELOPING SYSTEM
Fig. 26C IMAGE TRANSFERRING SYSTEM
Fig. 26D CLEANING SYSTEM
Fig. 26E DISCHARGING SYSTEM
Fig. 26F CLEANING ROLLER ROTATION
Fig. 26G DRUM ROTATION

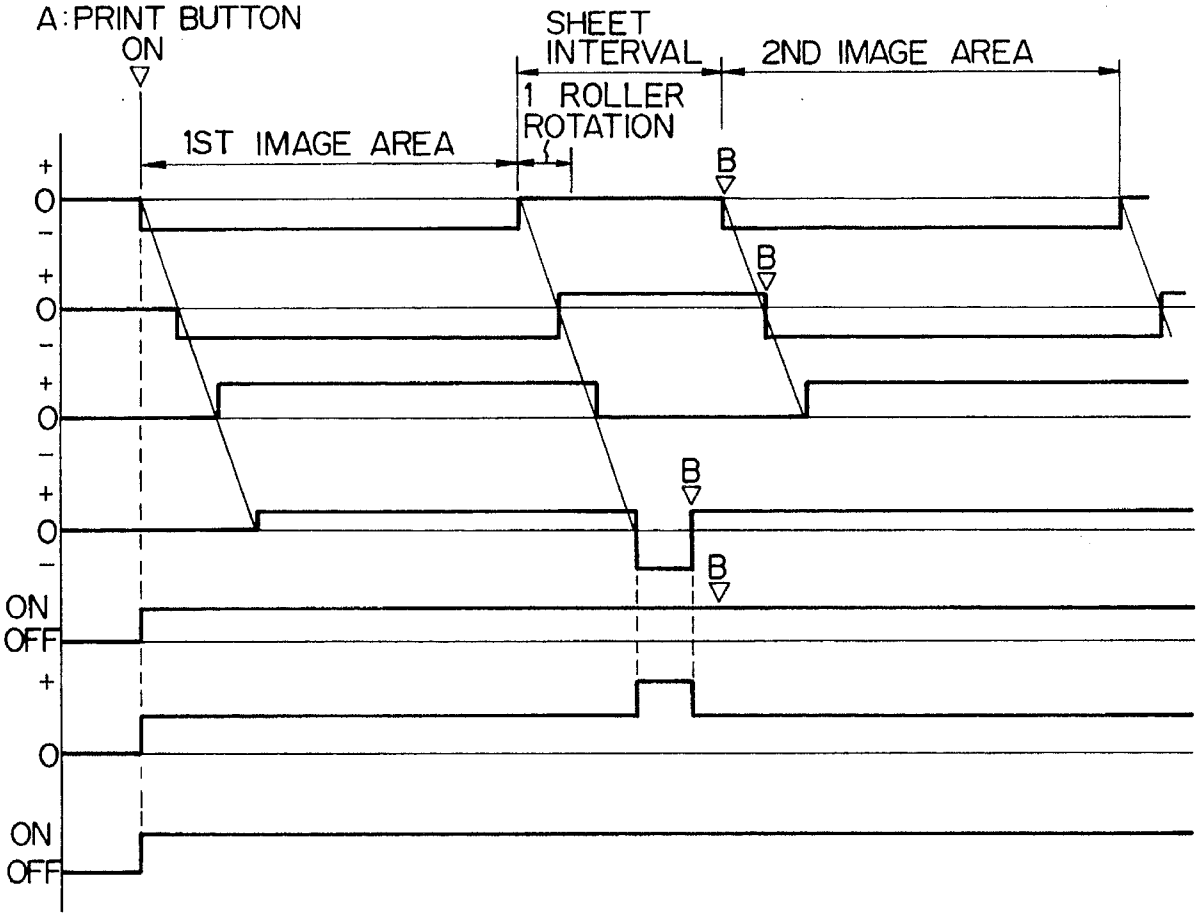
Fig. 27A CHARGING SYSTEM
Fig. 27B DEVELOPING SYSTEM
Fig. 27C IMAGE TRANSFERRING SYSTEM
Fig. 27D CLEANING SYSTEM
Fig. 27E DISCHARGING SYSTEM
Fig. 27F CLEANING ROLLER ROTATION
Fig. 27G DRUM ROTATION

CHARGING SYSTEM

DEVELOPING SYSTEM

IMAGE TRANSFERRING SYSTEM

CLEANING SYSTEM

CLEANING ROLLER

DISCHARGING SYSTEM

DRUM ROTATION

CHARGE ROLLER

REDEPOSITION TIME DURING IMAGE FORMATION
SHEET INTERVAL
JAM
B≒B' 2ND IMAGE LEAD EDGE
B'
B'
B:REDEPOSITED, TRAIL EDGE B

READY TO FORM IMAGE
DOOR CLOSED AFTER RECOVERY
1/2 DRUM ROTATION
1/2 DRUM ROTATION
D
C
D
C
C
D:REDEPOSITED TRAIL EDGE

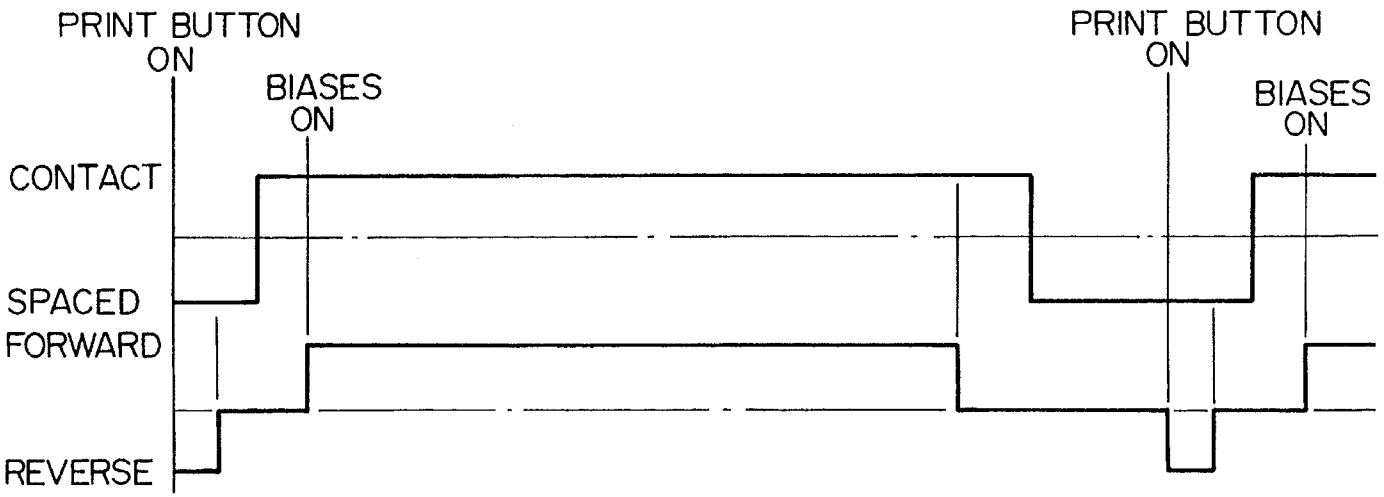
Fig. 31A CLEANING ROLLER
Fig. 31B DRUM

IMAGE FORMING APPARATUS AND CLEANING DEVICE THEREFOR

BACKGROUND OF THE INVENTION

The present invention relates to an image forming apparatus of the type using a two-ingredient type developer and transferring a toner image formed on an image carrier by the developer to a recording medium and, more particularly, to a cleaning device for removing toner left on the image carrier after image transfer.

An electrophotographic copier, laser printer, facsimile apparatus or similar image forming apparatus has an image carrier implemented by a photoconductor. The image carrier is uniformly charged and then exposed or optically scanned to electrostatically form a latent image thereon. The latent image is developed by a developer to turn out a toner image. The toner image is transferred to a paper sheet or similar recording medium to produce a copy. The developer is either a single-ingredient type developer, i.e., toner or a two-ingredient type developer which is a mixture of magnetic carrier and toner.

Ideally, the toner of the developer should be entirely transferred to a sheet. In practice, however, a part of the toner remains on the image carrier after image transfer. It has been customary with an image forming apparatus to remove the residual toner from the image carrier by use of a cleaning device. The cleaning device has a blade or a brush contacting the surface of the image carrier and for scraping off the toner mechanically. Usually, the toner removed from the image carrier is collected in a tank and then simply disposed of. However, it is desirable to recycle the waste toner in order to save limited resources.

In light of the above, there has been proposed an image forming apparatus capable of removing residual toner from an image carrier at a cleaning step, again depositing, or redepositing, the toner on the image carrier, and then collecting the toner conveyed by the image carrier in a developing device. Examples of this type of apparatus are disclosed in (1) Japanese Patent Publication No. 61-30274, (2) Japanese Patent Laid-Open Publication No. 6-51672, and (3) Japanese Patent Laid-Open Publication No. 5-61388.

In principle, the above apparatuses (1) and (2) each electrostatically attracts the toner remaining on the image carrier at a cleaning step, and then redeposits it on the image carrier. As the image carrier conveys the toner to the developing device, the toner is collected by the developing device. However, these apparatuses have various problems, as follows.

Generally, at the image transferring step, the toner to be transferred from the image carrier to a sheet is partly inverted in charge due to a transfer bias, i.e., it is charged partly to the positive polarity and partly to the negative polarity. Hence, at the cleaning step, only the toner of one polarity is electrostatically removed from the image carrier while the toner of the other polarity is left on the image carrier. Further, the apparatus (1) uses a lamp and corona discharge for implementing a discharging step which also joins in cleaning. This kind of discharging scheme, however, complicates the structure and produces ozone.

The apparatus (3) uniformizes the toner to be attracted in the cleaning step to the same polarity by frictional charging relying on a fur brush. However, because the probability that the fur brush contacts the toner is low, it is difficult to set up a frictional force intense enough to invert the polarity of the toner.

This again prevents the entire residual toner from being collected. In addition, the apparatus (3) needs not only the fur brush but also an extra member for collecting the toner from the fur brush, resulting in a complicated structure.

The residual toner will be surely attracted at the cleaning step if a uniform charge is deposited on the toner remaining on the image carrier, and if a bias opposite in polarity to the charge is applied. However, it is likely that the residual toner is partly inverted in polarity due to the influence of the polarity of the bias. Particularly, at the time of image transfer using a bias opposite in polarity to the bias for development, the charge of the toner sometimes adapts itself to the polarity of the transfer bias and consequently has the same polarity as the bias for attraction. Hence, even if the bias for the redeposition of the toner is provided with the same polarity as the charge of the toner and if a high voltage necessary for the transfer of the toner to the image carrier due to repulsion is applied, the toner opposite in polarity to the above bias due to the change in polarity is not transferred to the image carrier, but it remains on the cleaning member. As a result, the toner collection efficiency in the developing device is lowered. Moreover, in order that the toner collected by the cleaning member and including the toner whose polarity has changed may be redeposited on the image carrier by repulsion, there is needed a particular charging system for regularizing all the toner to the same polarity.

Frictional charging is a common implementation for charging the toner deposited on the cleaning member to the same polarity. For frictional charging, the image carrier and cleaning member are held in contact with each other to form a nip therebetween. The image carrier and cleaning member are each moved at a particular speed at the nip, thereby charging the toner by friction. However, frictional charging is not practicable without resorting to a great nip and, therefore, without increasing the size of the cleaning member. This increases the overall size of the apparatus. Further, a great nip reduces the area of the cleaning member available for attracting the toner and thereby obstructs the collection of the toner. In addition, when the cleaning member is implemented as a roller, an increase in the nip results in a decrease in the attraction area of the cleaning member, as measured in the circumferential direction. As a result, the probability that the toner retained on the cleaning member approaches the nip is high. Because the bias for image transfer is far higher than the bias used for the cleaning member to attract the toner, the toner on the cleaning member and adjoining the image carrier is reversely transferred to the image area of the image carrier due to the difference between the biases.

On the reverse transfer of the toner to the image area of the image carrier, the amount of toner to be frictionally charged at the nip increases to an unusual degree and increases the load on frictional charging, thereby obstructing the uniform polarity conversion. It is, therefore, difficult for the cleaning member to collect all the residual toner from the image carrier.

Assume that the cleaning member, whether it be moved in the same direction as or the opposite direction to the image carrier, retains the collected toner in an area less than its length as measured in the direction of movement. Then, only the limited area of the cleaning member is always used to attract and redeposit the toner. For example, when the cleaning member is implemented as a roller, only a part thereof repeatedly contacts the image carrier for the attraction and redeposition. As a result, the cleaning member is caused to locally wear and lower its cleaning characteristic. In this condition, the cleaning member is apt to fail to collect all the toner from the image carrier.

The image carrier is charged due to the influence of biases for image transfer and cleaning, depending on the material thereof. While this kind of charge deposited on the image carrier is usually dissipated before the next image formation, it cannot be done so, depending on the material of the image carrier. To dissipate the undesirable charge, use is made of a lamp in consideration of the photoconductive layer provided on the image carrier. However, the charge dissipation using a lamp is effective only if the charge is of negative polarity. Specifically, this kind of charge dissipation scheme is not applicable to a photoconductive layer formed of OPC (Organic Photo Conductor) or similar organic substance, because the organic substance sometimes allows a charge of positive polarity to remain thereon. Should the lamp scheme be practiced in combination with an organic photoconductive layer, the surface potential to be set by the next charging step would be irregular and change the potential distribution of a latent image, thereby adversely effecting the density of the resulting image.

For the transfer of the toner image from the image carrier to a sheet, use is made of a conductive member capable of contacting the image carrier. While the conductive member conveys the sheet in cooperation with the image carrier, a transfer bias is applied to the member in order to electrostatically transfer the toner image to the sheet. Usually, the transfer bias is stopped as soon as the conductive member fully conveys the sheet. However, when the trailing edge of the sheet is about to move away from the conductive member, the transfer bias influences the residual toner on the image carrier because the conductive member is positioned close to the image carrier. The conductive member is, therefore, apt to attract the toner from the image carrier. This part of the toner is transferred from the conductive member to the rear of the next sheet and smears it.

The collection of the residual toner from the image carrier is also performed for the initialization purpose. For example, just after the start-up of the apparatus or at the time of warm-up, cleaning is executed for initialization. Further, after the stop of operation of the apparatus due to a sheet jam or similar trouble, the image carrier is again rotated for initialization. As to the initialization to occur after a trouble, a great amount of toner, including toner to be transferred to a sheet, exists on the image carrier. The amount is sometimes too great for the cleaning member to remove by attraction, so that the toner sometimes partly remains on the image carrier. Then, when use is made of a charging device of the type contacting the image carrier, the toner penetrates between the charging device and the image carrier and makes it impossible for the charging device to perform uniform charging. As a result, white stripes appear on the image carrier and render the resulting image defective.

In order to obviate the above drawback, the voltage may be controlled in such a manner as to intensify the electric field to act on the cleaning member, as in the previously stated apparatus (2). This, however, brings about another problem that the photoconductive layer of the image carrier suffers from noticeable electrostatic fatigue and reduces the life of the image carrier. This is partly because the direction of the electric field is switched over in matching relation to the intensities of electric fields assigned to the attraction and redeposition of the toner, and partly because a relatively high potential for discharge is repeatedly applied.

Assume the cleaning member is constantly held in contact with the image carrier. Then, the cleaning member contacts the same part of the surface of the image carrier every time the image carrier is brought to a stop. When the cleaning member is implemented as a roller, the surface of the image carrier partly undergoes transformation because the components of the roller separate or because they chemically react with the photoconductive layer of the image carrier. This causes white stripes to appear in an image to be produced when the image carrier is started up later.

Furthermore, if the toner exists at the nip between the image carrier and the cleaning roller when the image carrier is brought to a stop, it is often degenerated. Particularly, in a hot and humid environment, the toner is likely to solidify and cause the cleaning roller to loose elasticity at the nip. This degrades the toner removing ability of the cleaning roller.

Assume that the charging member for executing the charging step subsequent to the cleaning step is of the type injecting charge in the image carrier in contact therewith. Then, the defective cleaning described above causes the residual toner to deposit on the charging member and prevent it from performing uniform charging.

On the other hand, the apparatuses (1) and (2) do not take account of problems particular to a developing system which develops a latent image by depositing toner of the same polarity as the charge of the image carrier in the exposed portion of the image carrier, i.e., so-called reverse development. Specifically, in a reverse developing system, a charger is usually held operative at all times because toner deposits in non-charged portions. However, when charging and discharging are effected over the toner which has been redeposited on the image carrier between images as usual, the amount of charge deposited on the toner increases with the result that the potential of the image carrier is caused to differ from the portions where the toner is present to the portions where it is absent. The irregular potential distribution on the image carrier, coupled with the increased amount of charge, makes it difficult to remove the toner from the image carrier and thereby makes the toner collection at the developing device defective.

SUMMARY OF THE INVENTION

It is, therefore, an object of the present invention to provide an image forming apparatus which is simple in construction and capable of transferring all the residual toner from an image carrier to a cleaning member.

It is another object of the present invention to provide an image forming apparatus capable of implementing a construction for collecting all the toner from an image carrier without increasing its overall size.

It is another object of the present invention to provide an image forming apparatus which enhances the cleaning ability and allows residual toner to be collected in a developing device and reused.

It is another object of the present invention to provide an image forming apparatus capable of obviating, at the time of initialization of an image carrier or when the apparatus is stopped before reaching a cleaning step and again started up or at the time of warm-up, defective cleaning attributable to a great amount of toner remaining on the image carrier, and thereby eliminating defective images and a decrease in the life of the image carrier.

It is another object of the present invention to provide an image forming apparatus capable of preventing white stripes or similar defects from appearing in an image.

It is another object of the present invention to provide an image forming apparatus which insures uniform charging by surely removing residual toner at a nip between an image carrier and a cleaning member.

It is another object of the present invention to provide an image forming apparatus which guarantees uniform charging for the next image formation.

It is another object of the present invention to provide an image forming apparatus capable of preventing toner transfer from a constituent part joining in an image forming process, particularly an image transferring device contacting an image carrier, to a sheet and thereby freeing the rear of the sheet from smears.

It is another object of the present invention to provide an image forming apparatus capable of collecting all the toner remaining on an image carrier.

It is another object of the present invention to provide an image forming apparatus of the type effecting reverse development and capable of efficiently collecting residual toner removed from an image carrier in a developing device.

In accordance with the present invention, an image forming apparatus capable of removing residual toner remaining on an image carrier after image transfer and collecting the toner has a developing device for developing a latent image electrostatically formed on the image carrier to thereby produce a corresponding toner image. An image transferring device transfers the toner image to a recording medium. A cleaning device applies, during a single image forming process using the image carrier, an electric field in one direction in order to attract and retain the residual toner, and then switches the direction of the electric field in order to redeposit the toner in the area of the image carrier which does not effect the next image formation. The image carrier conveys the toner to the developing device, so that the toner is electrostatically collected by the developing device. The cleaning device has a cleaning member contacting the image carrier and movable together with the image carrier, and for rubbing the residual toner at a nip between the cleaning member and the image carrier to thereby charge the toner to the same polarity and electrostatically attract the toner, and a voltage applying device for applying a voltage to the cleaning member.

BRIEF DESCRIPTION OF THE DRAWINGS

The above and other objects, features and advantages of the present invention will become more apparent from the following detailed description taken with the accompanying drawings in which:

FIGS. 10–15 are timing charts each demonstrating a particular operation of the apparatus shown in FIG. 3;

FIGS. 23–31 are timing charts each showing another particular operation of the apparatus of FIG. 3;

DESCRIPTION OF THE PREFERRED EMBODIMENTS

Figure 1:
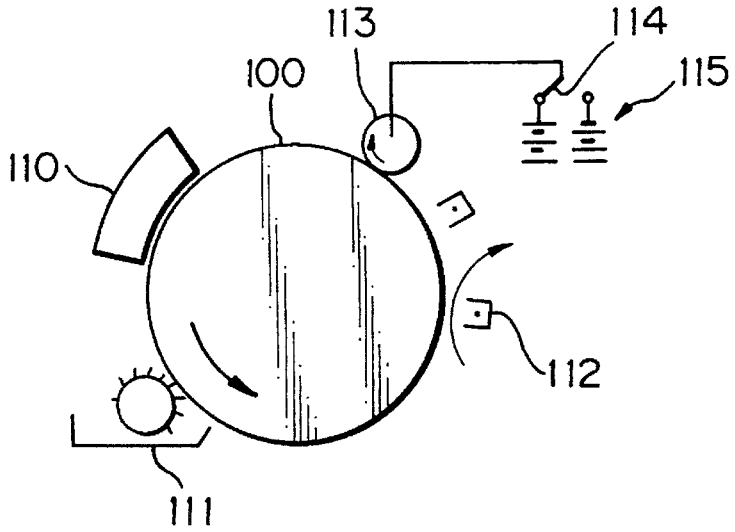
Fig. 1 PRIOR ART
FIGS. 1 and 2 are sections each showing a particular conventional image forming apparatus.

To better understand the present invention, the conventional apparatuses (1)–(3) will be described more specifically. The apparatus (1) is shown in FIG. 1 and has a photoconductive element 100 rotatable in a direction indicated by an arrow in the figure. Arranged around the drum 100 are various sections for executing an electrophotographic process and including a latent image forming section 110, a developing section 111, an image transferring section 112, and a roller 113. The latent image forming section 110 is made up of a charging portion and an exposing portion. A bias power source 115 is connected to the roller 113 via a switch or selector 114. The roller 113, bias power source 115 and switch 114 constitute a cleaning device, as follows. First, the power source 115 applies to the roller 113 a bias voltage opposite in polarity to residual toner left on the drum 100 during the course of a single copying process. The bias voltage causes the roller 113 to attract the residual toner thereonto. Subsequently, the power source 115 applies to the roller 113 a bias voltage opposite to the above voltage over a part of the surface of the drum 100 which does not effect image formation. As a result, the toner once deposited on the roller 113 is returned to, or redeposited on, the drum 100 and conveyed to the developing section 111.

Figure 2:
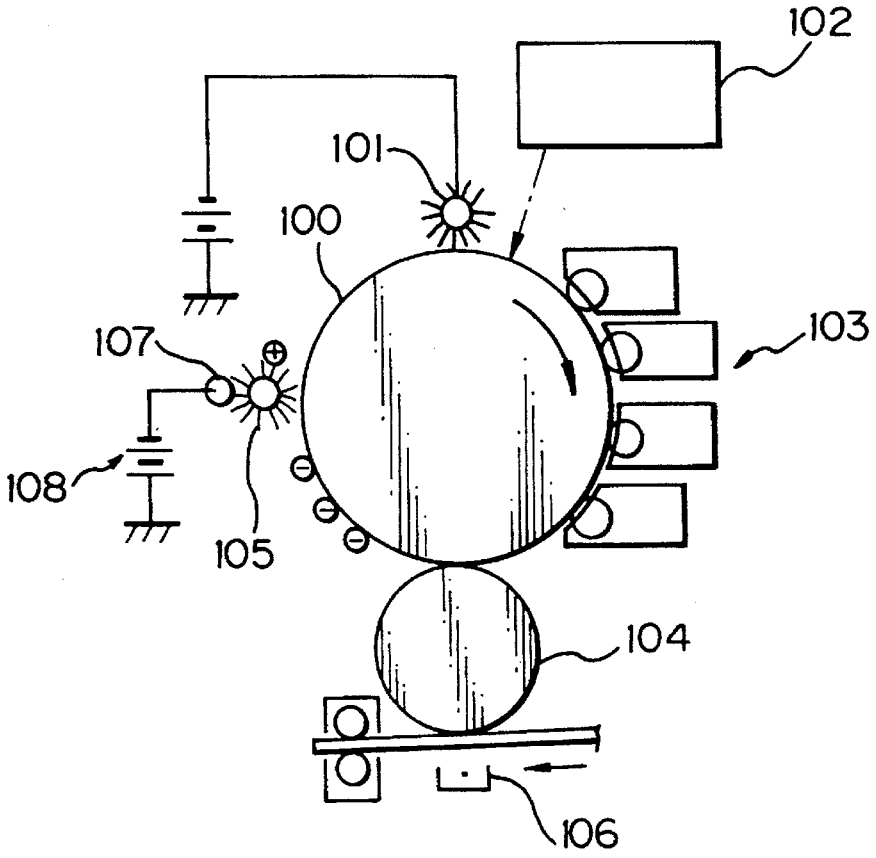
Fig. 2 PRIOR ART

As shown in FIG. 2, the apparatus (2) has a charging section 101, an exposing section 102, a plurality of developing units 103, an intermediate transfer drum 104, and a rotatable fur brush 105 for executing an electrophotographic process. These sections are arranged around a photoconductive drum 100. An image transfer unit 106 is associated with the drum 104. A collection roller 107 is held in contact with the fur brush 105. A bias power source 108 is connected to the roller 107. The fur brush 105 and bias power source 108 constitute a cleaning device. In operation, the brush 105, rotating in contact with the drum 100, scrapes off toner remaining on the drum 100 by friction, i.e., by inverting the polarity of the toner. The toner deposited on the brush 105 is transferred to the roller 107 which is biased to the polarity opposite to the polarity of the toner by the power source 108. The brush 105 is made of a material having a particular relation, as to the work function of the toner, to the polarity of the toner inverted at the time of scrape-off.

The apparatus (2), although not shown, has a conductive member contacting a photoconductive element. When the sheet contact portion of the photoconductive element, corresponding to an image forming area, contacts the conductive member, the conductive member is caused to attract residual toner thereonto. When a sheet non-contact portion corresponding to a non-image area contacts the conductive member, the conductive member redeposits the toner on the element. This toner is conveyed to a developing device by the photoconductive element and electrostatically collected by the developing device.

The apparatuses (1)–(3) described above have various problems left unsolved, as discussed earlier.

Figure 3:
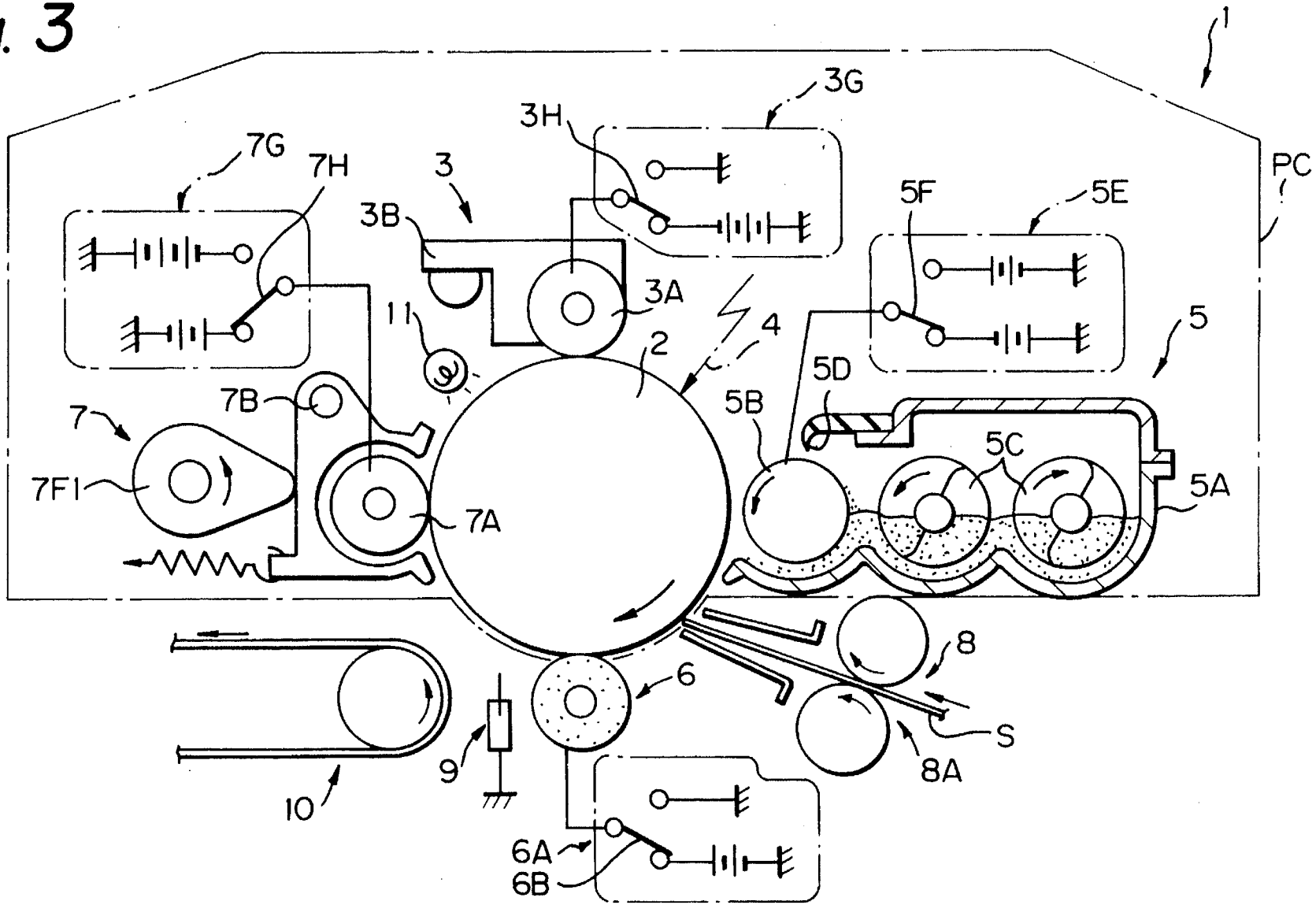
FIG. 3 is a section showing the basic construction of an image forming apparatus of the present invention.

Referring to FIG. 3, the basic construction of an image forming apparatus of the present invention is shown. As shown, the apparatus, generally 1, has an image carrier implemented as a photoconductive drum 2 by way of example. The drum 2 has thereon a photoconductive layer formed of OPC or similar organic substance. A drive mechanism, not shown, causes the drum 2 to rotate in a direction indicated by an arrow in the figure. A charging device 3, an exposing device 4, a developing device 5, an image transferring device 6, a cleaning device 7, and a discharging device 11 are arranged around and in the direction of rotation of the drum 2 in order to effect an image forming process. It is to be noted that such various devices other than the transferring device 6 may be constructed into a single process cartridge PC.

Figure 4:
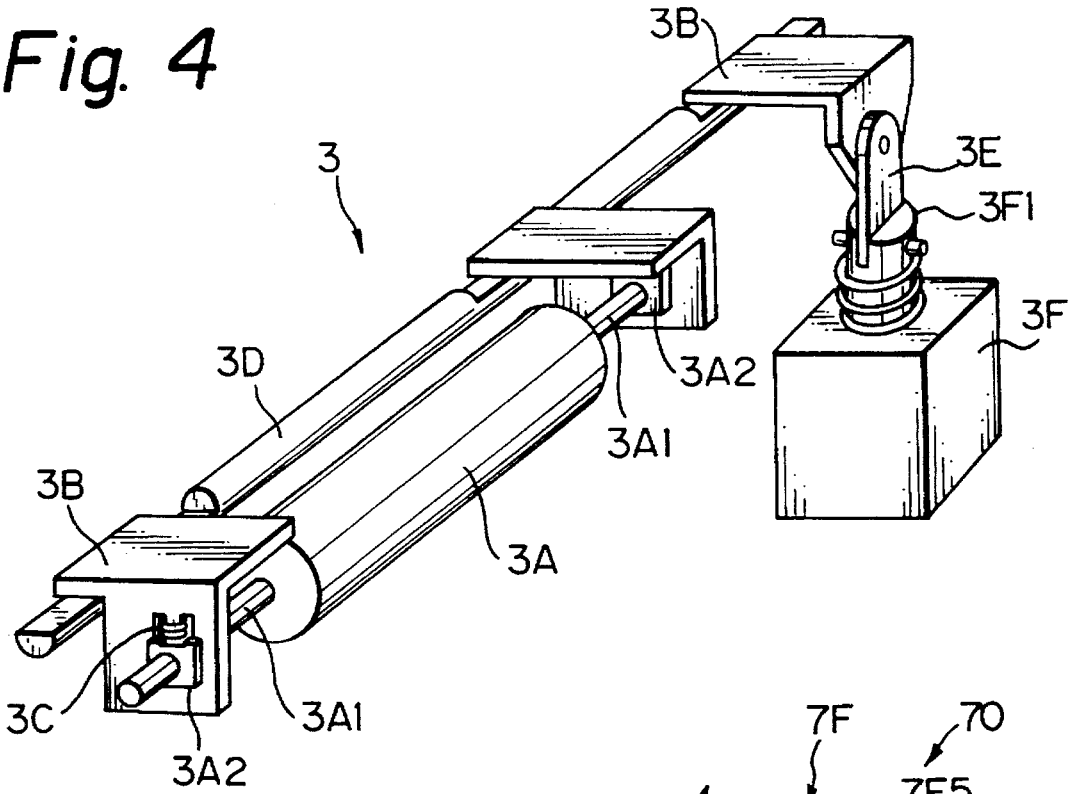
FIG. 4 is a perspective view of a charging device included in the apparatus of FIG. 3.

The charging device 3 is movable into and out of contact with the drum 2. As shown in FIG. 4 specifically, the charging device 3 is constructed to inject charge into the drum 2 in contact therewith. For this purpose, the device 3 has a conductive charge roller 3A movable into and out of contact with the drum 2. The charge roller 3A is mounted on a rotary shaft 3A which is supported by support plates 3A2. The support plates 3A2 are movable up and down relative to brackets 3B which are also movable up and down. In this configuration, when the charge roller 3A is brought into contact with the drum 2, it follows the rotation of the drum 2. A coil spring 3C is loaded between the shaft 3A1 and each support plate 3A2 so as to constantly bias the shaft 3A1 toward the drum 2.

The brackets 3B are implemented as angled pieces and affixed to an elevatable shaft 3D at their upper ends. The shaft 3D is a rod member having a flat surface to which the brackets 3B are affixed, as illustrated. When a drive piece 3E, which will be described, moves up or down, the shaft 3D is caused to move the brackets 3B up or down. As a result, the charge roller 3A is selectively moved into or out of contact with the drum 2.

The drive piece 3E is connected to an actuator 3F1 extending from a solenoid 3F. A coil spring 3F2 is loaded between the body of the solenoid 3F and the actuator 3F1. While the actuator 3F1 is not energized, i.e., in a usual condition, the actuator 3F1 is held in an elevated position by the coil spring 3F2. Hence, the charge roller 3A is spaced apart from the drum 2. Specifically, the solenoid 3F remains deenergized except for a charging step. Therefore, the charge roller 3A contacts the drum 2 only during the charging step and thereby uniformly charges the photoconductive layer of the drum 2.

Referring again to FIG. 3, the charging device 3 includes a power source 3G connected to the charge roller 3A. The power source 3G has a circuit for applying a charge potential of −850 V to the charge roller 3A, a grounding circuit, and a switch 3H for selecting one of the two circuits. When the charge roller 3A is held in contact with the drum 2, the switch 3H selects the −850 V circuit. The switch 3H is implemented by a microswitch or a transistor or similar electronic part and operated either manually or automatically. This kind of switch arrangement also applies to the other switches which will be described later.

The exposing device 4 uses an optical writing system which emits a laser beam in response to an image signal input from an image scanner. The device 4 electrostatically forms a latent image on the drum 2. If desired, the optical writing system may be replaced with a system which illuminates a document laid on a glass platen by use of focusing optics.

The developing device 5 uses a magnet brush. For the magnet brush, the present invention uses a two-ingredient type developer in which frictionally charged toner is magnetically deposited on carrier. For this reason, the developing device 5A has a developing sleeve 5B and an agitator screw 5C disposed in a casing 5A. The sleeve 5B is rotatable while adjoining the surface of the drum 2. The agitator screw 5C charges the toner by friction. The sleeve 5B has thereinside magnetic poles facing the drum 2 and constituting main poles for development, and magnetic poles for conveying the developer. With these poles, the sleeve 5B causes the developer to form a magnet brush thereon. The magnet brush is regulated in amount by a doctor 5D and then brought into contact with a latent image formed on the drum 2, thereby developing the latent image.

A power source 5E is connected to the sleeve 5B and applies thereto a bias for promoting the electrostatic transfer of the toner to the latent image carried on the drum 2. The power source 5E has a circuit for applying a voltage of −600 V to the sleeve 5B, a circuit for applying a voltage of +150 V to the sleeve 5B, and a switch 5F for selecting one of the two circuits. The switch 5F selects one of the two different voltages at the time of development and selects the other voltage at the time of attraction of the toner left on the drum 2 and inverted in polarity, as will be described later specifically. In FIG. 3, the switch 5F selects −600 V at the time of development or +150 V at the time of attraction. This promotes, at the time of development, the transfer of the toner from the sleeve 5B to the drum 2 due to repulsion and promotes, at the time of attraction, the transfer of the toner whose polarity has been inverted.

The image transferring device 6 is implemented by a semiconductive roller formed of urethane rubber containing carbon or similar conductive material therein. The roller is capable of contacting the drum 2 and connected to a bias power source 6A for image transfer. The power source 6A has a circuit for applying a transfer bias of +950 V, a grounding circuit, a circuit, not shown, for applying a voltage higher than the transfer bias, and a switch 6B for selecting one of the three circuits. The transfer bias is applied to the roller when a developed image or toner image is to be electrostatically transferred from the drum 2 to a sheet S which is fed from a sheet feeding device 8. The voltage higher than the transfer bias is selected when the redeposition area of the drum 2 faces the roller. Specifically, assume that the toner negatively charged by the bias of the developing device 5 is partly left on the drum 2 around the trailing edge of the image forming area, and that this part of the toner is transferred to the semiconductive roller by the transfer bias (+950 V) and positively charged thereby. Then, the above voltage higher than the transfer bias causes the toner to be transferred from the roller to the redeposition area of the drum 2.

The sheet feeding device 8 has a cassette loaded with a stack of sheets S. A sheet S is fed from the cassette to a registration roller pair 8A. The roller pair 8A drives the sheet S at such a timing that it meets the leading edge of the toner image carried on the drum 2.

Figure 5:
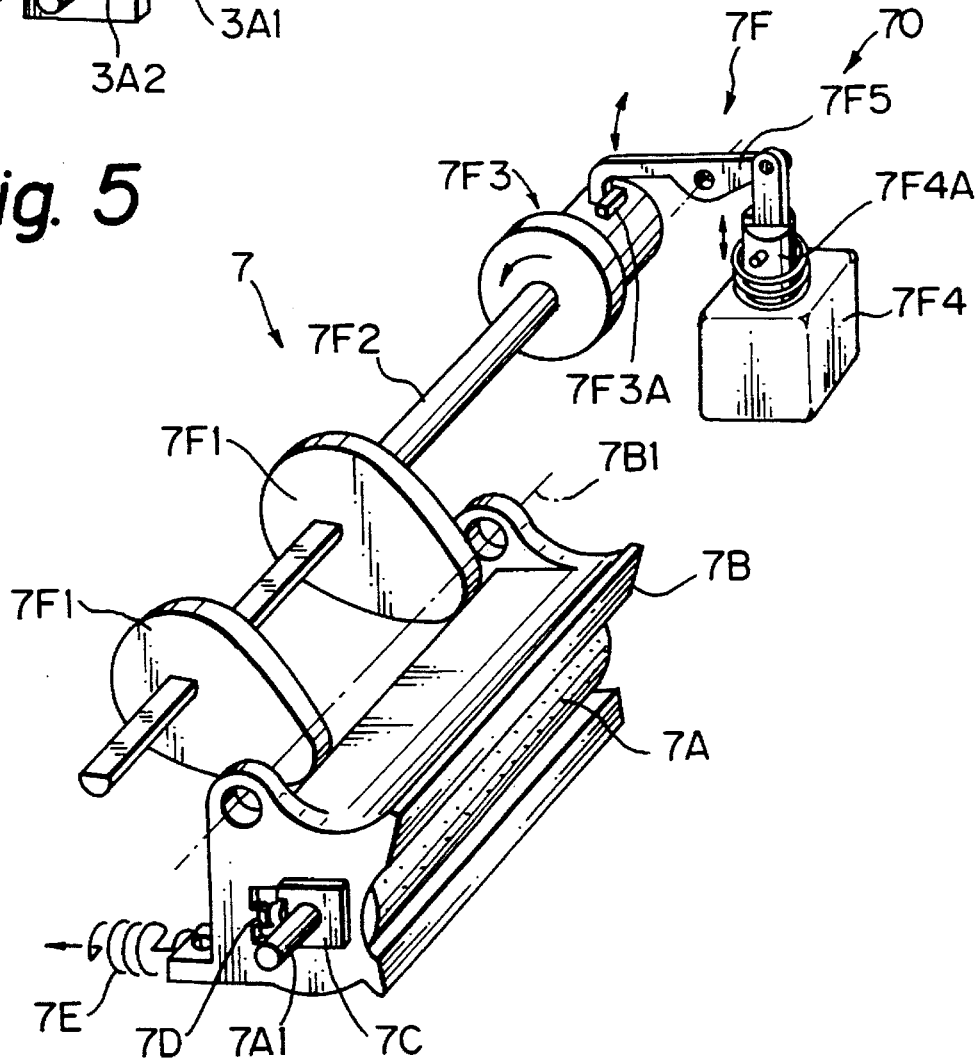
FIG. 5 is a perspective view of a cleaning device also included in the apparatus of FIG. 3.

The cleaning device 7 is movable into and out of contact with the drum 2. As shown in FIG. 5 specifically, the device 7 has a cleaning roller 7A supported by moving means 70, which will be described, in such a manner as to be movable into and out of contact with the drum 2. The cleaning roller 7A is mounted on a rotary shaft 7A1 which is journalled to support plates 7C (only one is visible). The support plates 7C are slidably supported by a casing 7B. The casing 7B is configured such that a part of the roller 7A can be partly exposed to the outside. A coil spring 7D is loaded between the casing 7B and each support plate 7C and constantly biases the roller 7A toward the drum 2. The roller 7A is rotated in a preselected direction such that after the image transfer it will contact the drum 2 and move in the same direction as the drum 2. However, the roller 7A is rotated at a slightly higher speed than the drum 2 when brought into contact with the drum 2. In this condition, the roller 7A rubs the toner remaining on the drum 2. In the construction shown in FIG. 3, the roller 7A is rotated at a speed 1.4 times as high as the speed of the drum 2.

As shown in FIG. 5, a shaft 7B1 is passed through the upper portion of the casing 7B. The casing 7B is pivotable about the shaft 7B1 in a direction for moving the roller 7A into contact with the drum 2, and a direction for moving it away from the drum 2. A tension spring 7E is loaded between the lower portion of the casing 7B and a stationary member, not shown, for biasing the roller 7A away from the drum 2.

The previously mentioned moving means 70 is constituted by a drive section 7F which moves the casing 7B. The drive section 7F has eccentric cams 7F1, a can shaft 7F2, a one-way clutch 7F3, a solenoid 7F4, and a clutch lever 7F5. The eccentric cams 7F1 are mounted on the cam shaft 7F2 which is, in turn, connected to the one-way clutch 7F3. A lug 7F3A is formed on the drum portion of the clutch 7F3. A clutch lever 7F5 is connected to an actuator 7F4A extending from a solenoid 7F4 and is angularly movable. One end of the clutch lever 7F5 faces the lug 7F3A of the clutch 7F3. The clutch 7F3 is so constructed as to stop the rotation of the cam shaft 7F2 when the larger diameter portions of the cams 7F1 contact the rear of the casing 7B and when the smaller diameter portions of the same contact it. Hence, a pair of lugs 7F3A are positioned on the clutch 7F3 and angularly spaced 180 degrees from each other.

A control section, not shown, controllably drives the solenoid 7F4. When the solenoid 7F4 is deenergized, i.e., in a usual condition, the actuator 7F4A of the solenoid 7D4 is held in a protruded position. As a result, the clutch lever 7F5 is rotated counterclockwise, as viewed in FIG. 5, and abuts against one of the lugs 7F3A. The solenoid 7F4 is energized in the event when the positional relation between the cams 7F1 and the casing 7B is to be changed. When the larger diameter portions of the cams 7F1 abut against the rear of the casing 7B, the roller 7A contacts the drum 2. When the smaller diameter portions of the cams 7F1 abut against the casing 7B, the roller 7A is spaced from the drum 2.

As shown in FIG. 3, a power source 7G for cleaning is connected to the cleaning roller 7A. The power source 7G has two circuits for respectively applying +300 V and −500 V to the roller 7A, a circuit, not shown, for applying +500 V to the roller 7A, and a switch 7H for selecting one of the three circuits. The three circuits are each used to form an electric field contributing to the transfer of the toner. Specifically, the +300 V circuit forms an electric field for attracting the residual toner from the drum 2. After the toner remaining on the image forming area of the drum 2 has been fully collected on the roller 7A, the −500 V and +500 V circuits are selectively used to form an electric field for transferring the toner from the roller 7A back to the drum 2.

Figure 6:
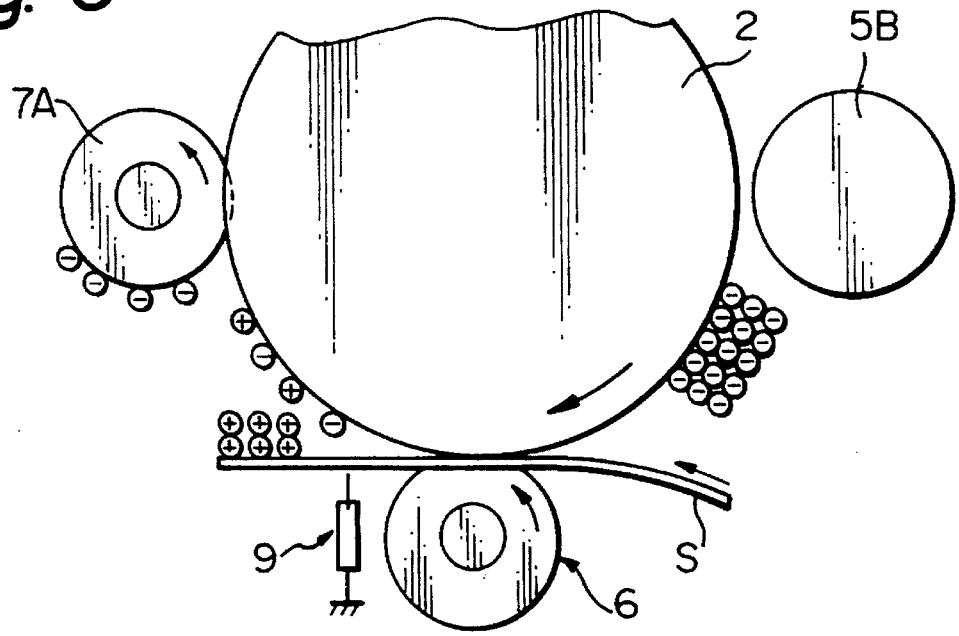
FIG. 6 schematically shows toner remaining on an image carrier also included in the apparatus of FIG. 3 after image transfer.

Why the bias voltages are switched over as stated above is as follows. The toner deposited on the drum 2 by the developing device 5 has been charged to the negative polarity by the bias for development. At the image transferring step, the toner to be transferred to the sheet S is charged to the positive polarity by the bias for image transfer. As a result, the toner left on the drum 2 after the image transfer is partly negative and partly positive in polarity. This condition is illustrated in FIG. 6.

Figure 7:
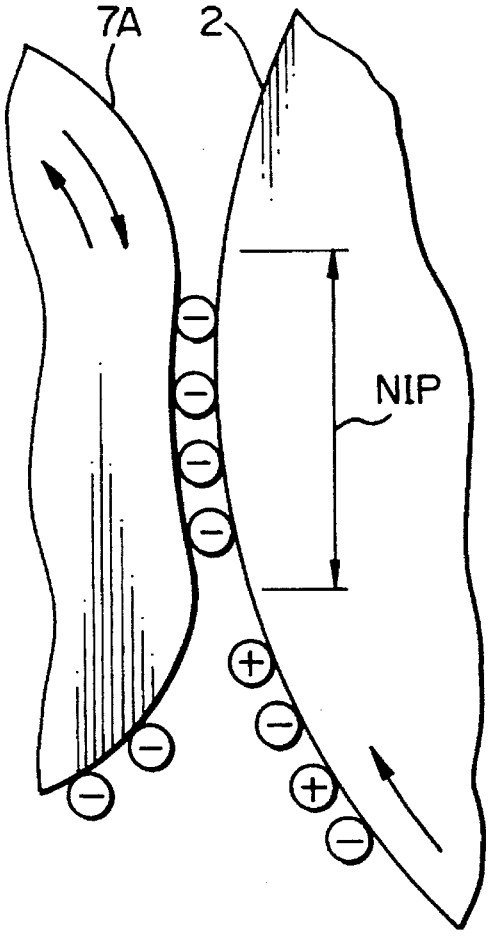
FIG. 7 schematically shows the toner on the image carrier facing the cleaning device.

On the other hand, as shown in FIG. 7, the residual toner on the drum 2 is brought to a nip between the cleaning roller 7A and the drum 2. At this nip, the toner is charged by friction attributable to the difference in peripheral speed between the drum 2 and the roller 7A. The friction is so selected as to charge the entire toner to the negative polarity. The negatively charged toner is attracted by an electric field formed by +300 V which is applied from the power source 7G to the roller 7A. As a result, the toner is transferred from the drum 2 to the roller 7A.

Figure 8:
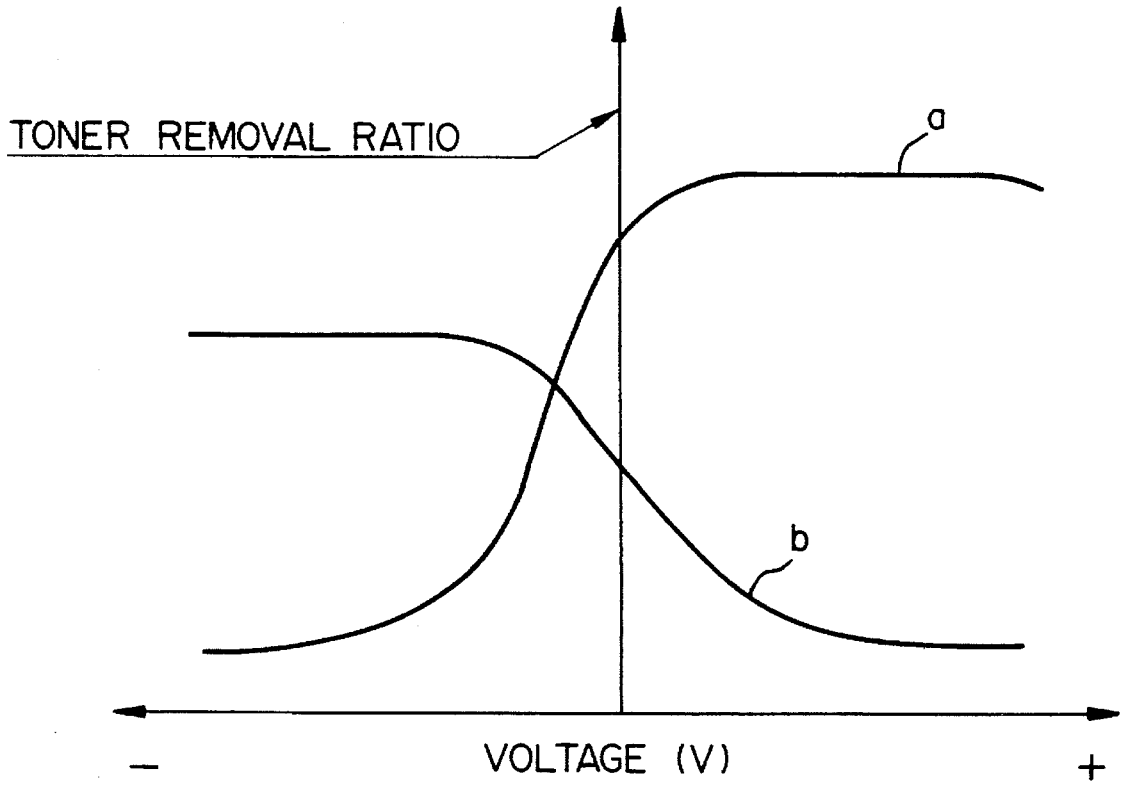
FIG. 8 shows a relation between a voltage and a toner removal ratio attainable therewith.

FIG. 8 shows a relation between the voltage and the toner removal ratio attainable therewith. In FIG. 8, the ordinate and abscissa respectively indicate the toner removal ratio and the voltage. A curve a is representative of toner charged to the negative polarity by the friction between the drum 2 and the cleaning roller 7A, FIG. 3. A curve b is representative of toner charged to the positive polarity by the friction between the drum 100 and the fur brush 105 shown in FIG. 2.

As the curve a indicates, when the negative bias applied to the cleaning roller 7A is sequentially intensified, the toner removal ratio sharply falls and allows almost no toner to be removed. However, when the positive bias is applied to the roller 7A, the toner removal ratio sharply increases and allows a desirable condition to be maintained. This proves that the toner between the drum 2 and the roller 7A is entirely charged to the negative polarity. By contrast, as the curve b indicates, when the negative bias applied to the collection roller 107, FIG. 2, is sequentially intensified, the toner removal ratio increases immediately, but not to a noticeable degree. This shows that when the fur brush 104 rubs the toner remaining on the drum 100, a frictional force great enough to charge the toner to the same polarity is not achievable; that is, not all the toner is charged to the positive polarity.

It will be seen from the above that by rubbing the residual toner with the roller 7A, it is possible to attain a frictional force great enough to charge the toner to the same polarity and, therefore, to achieve a higher toner removal ratio than conventional.

Figure 9:
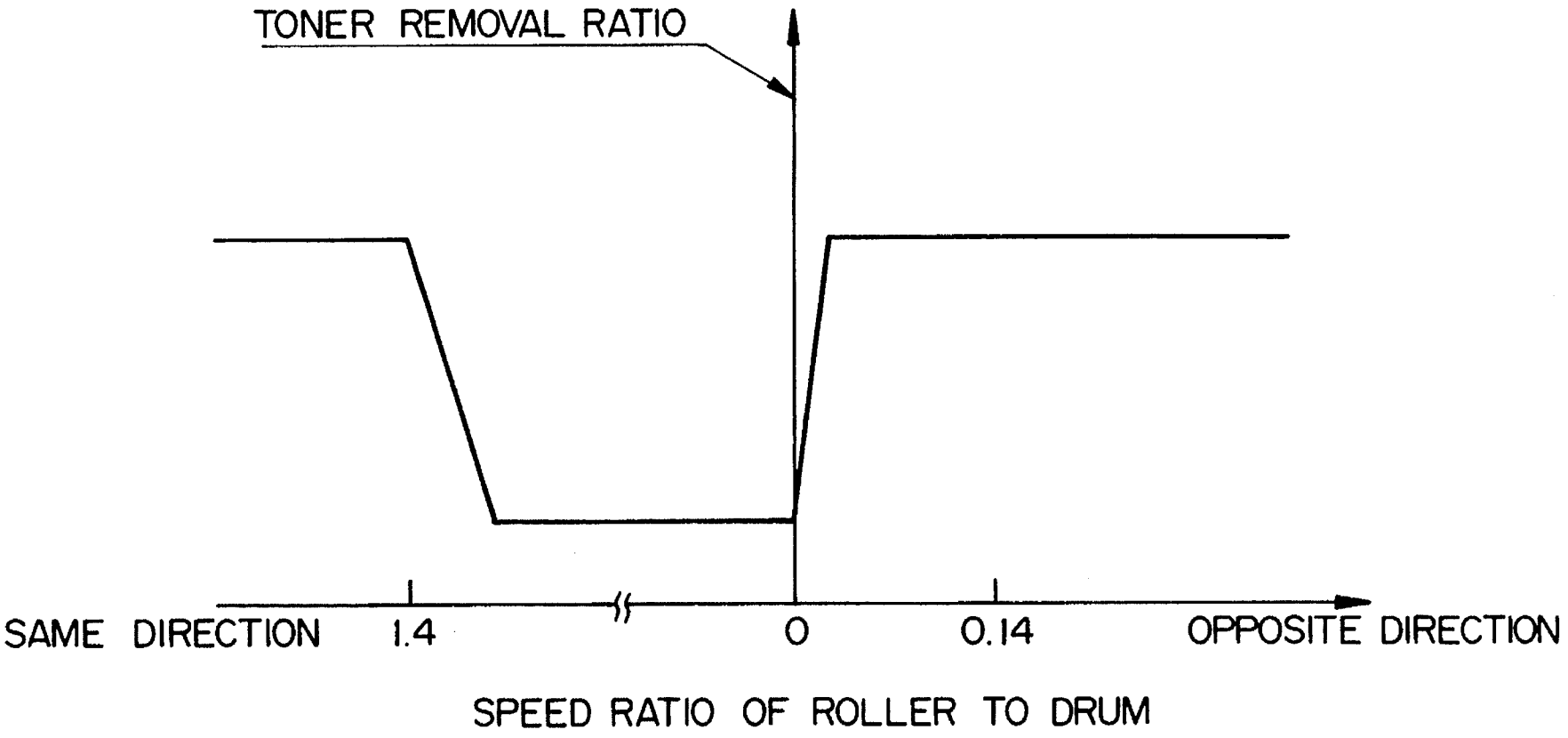
FIG. 9 shows a relation between a speed ratio of a cleaning roller to a photoconductive element and a toner removal ratio attainable therewith.

FIG. 9 indicates the toner removal ratio on the ordinate and the ratio of the speed of the roller 7A to the speed of the drum 2 on the abscissa. On the abscissa, "0" shows a condition wherein the cleaning roller 7A is brought to a stop while the drum 2 is rotated. As shown, when the roller 7A is rotated in the same direction as the drum 2 at the nip between the former and the latter, the toner removal ratio does not increase until the rotation speed of the roller 7A becomes 1.4 times as high as that of the drum 2. That is, unless the speed ratio is increased, a frictional force great enough to charge the toner to the same polarity is not attainable. On the other hand, when the roller 7A is rotated in the opposite direction to the drum 2 at the nip, the toner removal ratio increases immediately; the necessary frictional force is achievable with a smaller speed ratio.

It follows that in order to enhance the toner removal ratio, the roller 7A may be rotated in the opposite direction to the drum 2 at the nip, although such a configuration is not shown or described specifically. This configuration is an alternative to the above configuration wherein the roller 7A is rotated in the same direction as the drum at the nip.

In the basic construction described above, when the toner deposited on the roller 7A is to be reused, the power source 7G applies a voltage of opposite direction to the roller 7A. This voltage returns the toner from the roller 7A to the surface of the drum 2 where the next image has not yet been formed. In the developing device 5, the power source 5E applies a voltage to the sleeve 5B in order to cause it to collect the toner from the drum 2. Alternatively, an arrangement may be made such that the power source 6A of the image transferring device 6 applies a voltage to the device 6 in order to charge the surface of the drum 2. Then, the toner deposited on the roller 7A will be redeposited on the drum 2 and then collected by the sleeve 5B to which a voltage is applied from the power source 5E.

The roller 7A is formed of a conductive material capable of receiving the bias voltage and charging the toner to the negative polarity by friction.

After the image area of the drum 2 has moved away from the roller 7A, −500 V is applied to the roller 7A from the power source 7A in order to form an electric field acting in the opposite direction. As a result, the toner deposited on the roller 7A is returned to the drum 2 due to repulsion. As the drum 2 is in rotation, the toner redeposited on the drum 2 is brought to the position where the drum 2 is located. At this position, the toner is transferred from the drum 2 to the sleeve 5B because the bias for development has been switched to the positive polarity.

In this way, the apparatus of FIG. 3 removes the residual toner from the drum 2 with the cleaning device 7 and collects it with the developing device 5 by controlling the bias to be applied to the device 7. Also shown in FIG. 3 are a needle 9 for dissipating a charge left on the sheet S, a conveying unit 10 for conveying the paper S to a fixing unit, not shown, and a discharging device 11 implemented by a lamp and turned on while the drum 2 is in movement.

Preferred embodiments of the present invention will be described hereinafter.

Figures 10A, 10B, 10C, 10D, 10E, 10F, 10G:
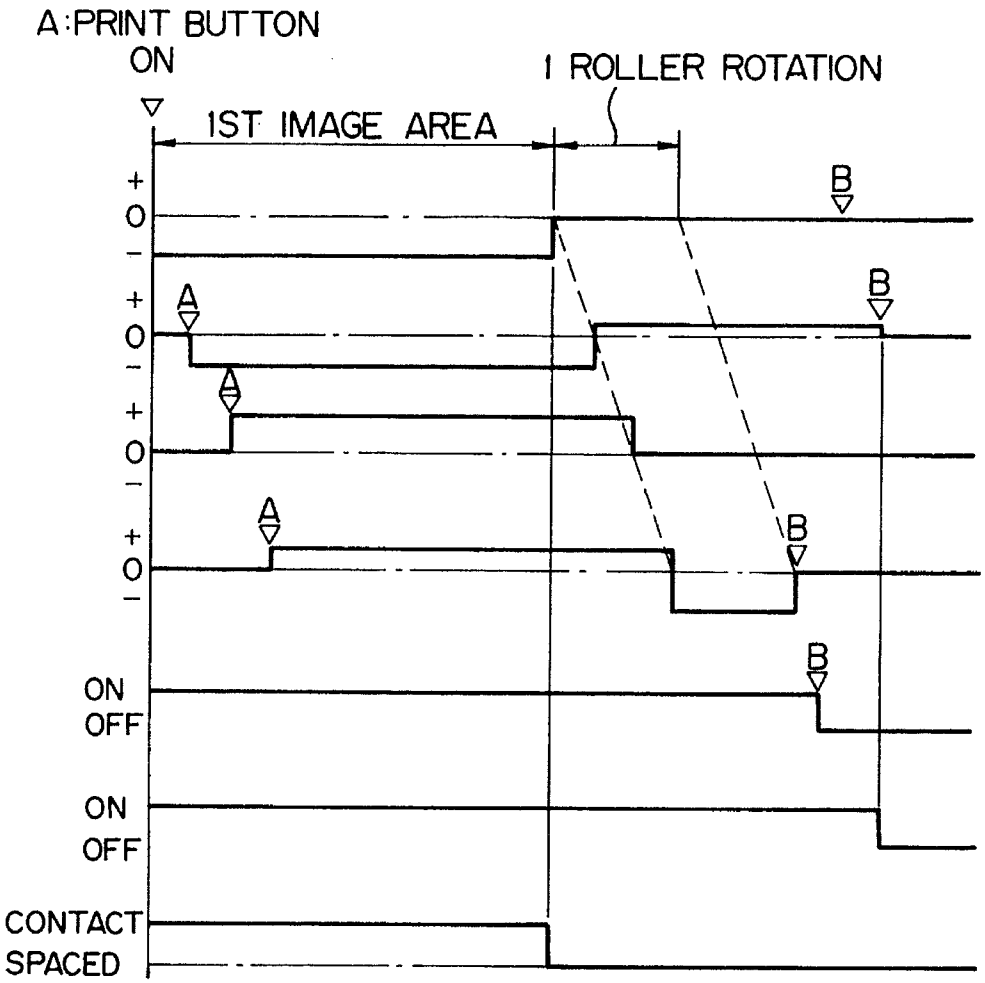

FIG. 10 is a timing chart for describing a first embodiment of the present invention. An image forming step to be described concentrates on negative-to-positive development by way of example. Referring to FIGS. 3 and 10, when a print button, not shown, is pressed (ON), the drum 2 starts rotating. In the charging device 3, the solenoid 3F is energized to bring the charge roller 3A into contact with the drum 2. At the same time, the switch 3H of the power source 3G selects the negative −850 V, so that the drum 2 is uniformly charged to the negative polarity. A latent image is formed on the charged surface of the drum 2 by the optics included in the exposing device 4. The surface potential of the drum 2 is −150 V in a portion of the latent image corresponding to a black solid image. When the latent image is brought to the developing device 5 by the drum 2, it is developed by the sleeve 5B to turn out a toner image. Specifically, because the −600 V bias is applied from the power source 5E to the sleeve 5B, the toner of the developer carried on the sleeve 5B is transferred to the latent image.

The toner image is conveyed to the image transferring device 6 by the drum 2. In the device 6, the +950 V bias output from the power source 6A causes the toner, forming the toner image, to be transferred from the drum 2 to the sheet S fed from the sheet feed device 8. Subsequently, the sheet S is separated from the drum 2 and then conveyed to the fixing device, not shown. The fixing device fixes the toner on the sheet S by applying heat thereto.

After the image transfer, the drum 2 moves toward the cleaning device 7. This is followed by the cleaning procedure which causes the cleaning device 7 to remove the toner remaining in the image area of the drum 2, and then causes the developing device 5 to collect it. The residual toner on the drum 2 is partly positive and partly negative in polarity, as stated with reference to FIG. 6. In practice, however, much of the toner is positively charged due to the difference between the transfer bias and the developing bias.

In the cleaning device 7, the roller 7A is caused to start contacting the drum 2 at the time when the print button is pressed, inclusive of the time when an image begins to be formed in the first image area of the drum 2. The charging device 3 is moved away from the drum 2 when it has charged the image area up to the trailing edge. Hence, a charge potential of 0 V is deposited on the area following the image area.

When the moving means 70, FIG. 5, has the solenoid 7F4 thereof energized, the larger diameter portions of the eccentric cams 7F1 are caused to abut against the rear of the casing 7B. As a result, the cleaning roller 7A is brought into contact with the drum 2, forming the previously mentioned nip. At the nip, the residual toner on the drum 2 is charged to the negative polarity by friction. At this instant, +300 V is applied from the power source 7G to the roller 7A and causes the roller 7A to attract the toner of negative polarity.

After the roller 7A has collected the toner from the drum 2 up to the trailing edge of the image area, −500 V is applied from the power source 7G to the roller 7A in place of 300 V. This voltage is of the same polarity as the bias applied in the developing device 5. As a result, the direction in which the electric field acts between the drum 2 and the roller 7A is reversed. −500 V is continuously applied to the roller 7A from the time when the trailing edge of the first image area of the drum 2 moves away from the roller 7A to the time when the leading edge of the next image area arrives at the roller 7A. Hence, the toner deposited on the roller 7A is returned by repulsion to the area of the drum 2 which does not join in image formation.

Subsequently, the drum 2 carrying the toner reaches the discharging device 11. The device 11 deposits a potential of 0 V on the drum 2. Then, the drum 2 reaches the charging device 3. At this time, the charging device 3 has already been moved away from the drum 2 and has stopped the application of the voltage from the power source 3G. Hence, the drum 2 advances to the developing device 5 without being charged by the device 3.

At the time when the trailing edge of the first image area of the drum 2 has moved away from the charging device 3, the surface potential of the drum 2 is 0 V. In practice, however, the drum 2 is charged to about +20 V after the image transfer due to the transfer bias, and to about −50 V after the cleaning due to the cleaning bias. This does not matter at all because the surface potential of the drum 2 is reduced on reaching the discharging device 11 to such a degree that the electrostatic relation between the drum 2 and the toner is excluded.

In the developing device 5, the voltage applied from the power source 5E to the sleeve 5B is switched from −600 (developing bias) to +150 V as soon as the trailing edge of the first image area of the drum 2 moves away from the sleeve 5B. The voltage of −600 V is opposite in polarity to the toner conveyed to the device 5 by the drum 2. Consequently, the toner is transferred from the drum 2 to the sleeve 5B.

In the cleaning device 7, after the trailing edge of the first image area of the drum 2 has moved away from the roller 7A, the roller 7A makes one full rotation corresponding to a distance which allows the toner to be redeposited on the drum 2. Then, the roller 7A is moved away from the drum 2. This prevents the toner from being reversely transferred from the roller 7A to the image area of the drum 2 and contaminating the background of the drum 2. The drum 2 moved away from the developing device 5 reaches the cleaning device 7. However, because the roller 7A is spaced from the drum 2, the residual surface potential of the drum 2 is simply dissipated by the discharging device 11 to prepare the drum 2 for the next charging step.

FIG. 11 shows how the toner collection procedure described above is executed between consecutive sheets. As shown, the toner collection between consecutive sheets is executed in the same manner as in FIG. 10. However, the difference is that the rotation speed at the time when the toner is returned from the roller 7A to the drum 2 is not selected to be less than 1 in terms of linear speed ratio, but it is selected to be greater than 1. This reduces the period of time necessary for the return of the toner to the drum 2 which is effected during the interval between sheets. It is to be noted that the interval between sheets is used to form the next image on the drum 2. As a result, the interval up to the formation of the second image is reduced.

A second embodiment of the present invention will be described. In the apparatus shown in FIG. 3, it may occur that due to the influence of the transfer bias, the toner collected by the roller 7A remains in the positive polarity despite the frictional charge effected at the nip. Then, the toner cannot be released from the roller 7A despite the negative polarity for redeposition. In light of this, the alternative embodiment uses a voltage of +500 V which is of the same polarity as, but higher than, the bias used to attract the frictionally charged toner at the nip. With +500 V, it is possible to transfer the positively charged toner to the redeposition area of the drum 2.

For this purpose, the roller 7A makes two rotations when it faces the redeposition area of the drum 2 which does not influence the next image forming area, starting from the trailing edge of the preceding image area. During the first rotation, +500 V capable of redepositing the positively charged toner on the drum 2 by repulsion is applied to the roller 7A. During the second rotation, −500 V which is of the same polarity as the frictional charge deposited on the toner and capable of transferring the toner to the drum 2 by repulsion is applied to the roller 7A.

The operation of the second embodiment will be described more specifically with reference to FIGS. 3 and 12–15. Let the following description concentrate on negative-to-positive development.

Regarding the collection of the toner from the drum 2, the second embodiment basically operates in the same manner as the first embodiment. The polarity of the voltage to be applied to the roller 7A is the key to the collection of the toner from the drum 2 to the roller 7A and the redeposition of the toner on the drum 2. Although the toner remaining on the drum 2 is charged to the negative polarity by friction at the nip shown in FIG. 7, it is sometimes partly inverted in polarity due to the polarity of the transfer bias. The toner on the roller 7A and inverted to the positive polarity is left on the roller 7A even at the time of redeposition due to the influence of −500 V applied to the roller 7A.

The second embodiment is capable of redepositing all the toner collected by the roller 7A and including the toner inverted in polarity on the drum 2.

Specifically, as shown in FIG. 12, on facing the redeposition area of the drum 2, the roller 7A makes two rotations. During the first rotation, +500 V higher than +300 V for the collection of the toner from the drum 2 is applied to the roller 7A. For the second rotation, −500 V opposite in polarity to +500 V is applied to the roller 7A. +500 V is of the same polarity as, but higher than, the bias used to attract the toner charged by friction at the nip. In the illustrative embodiment, the polarity is switched such that the toner retained on the roller 7A and inverted to the positive polarity is redeposited on the drum 2 first, and then the toner of negative polarity is redeposited on the drum 2.

On the other hand, in the developing device 5, a voltage lower than +150 V, which is the bias voltage assigned to the usual collection of the negative toner from the drum 2, is applied at a timing indicated by dash-and-dot lines in FIG. 12. This allows the toner inverted to the positive polarity and returned from the roller 7A to the drum 2 to move toward the device 5 easily due to the difference between the above voltage and the bias voltage of the roller 7A. Why the toner inverted to the positive polarity is redeposited on the drum 2 and collected by the device 5 first is that a period of time necessary for the change of polarity in the device 5, which relies on friction, should be available. After the collection of the toner inverted to the positive polarity, +150 V is again substituted for the voltage higher than it in order to collect the toner of negative polarity from the drum 2.

In the illustrative embodiment, the drum 2 is charged by biases at the image transferring step and cleaning step. Specifically, the drum is charged to −20 V at the image transferring step and charged to +50 V at the cleaning step. Because the discharging device 11 uses an optical discharge scheme, it is effective only for negative charge when the drum 2 is formed of OPC or similar organic substance. It is, therefore, necessary to invert the positively charged surface of the drum 2 to the negative polarity or to lower the surface potential, even if it is of negative polarity, to a level which is easy to dissipate, as follows.

FIG. 13 shows a specific procedure wherein after the toner redeposited on the drum 2 has been collected by the developing device 5, the polarity of the surface potential of the drum 2 is inverted to the negative polarity by the image transferring device 6 when the drum 2 faces the device 6. FIG. 14 shows another specific procedure wherein after the collection of the redeposited toner by the device 5, the surface potential of the drum 2 is inverted to the negative polarity by the cleaning device 7 when the drum 2 faces the device 7.

When the drum 2 inverted in polarity by the transferring device 6 or the cleaning device 7 as mentioned above faces the discharging device 11, the device 11 deposits a surface potential of 0 V on the drum 2 by illumination. The drum 2 is now ready to be uniformly charged by the next charging step.

As stated above, the embodiment reduces the load on the discharging device and thereby reduces the proportion of the discharging time to the entire image forming time.

In the embodiment, in the event of the attraction of the toner from the drum 2 by the cleaning device 7 and the redeposition of the toner on the drum 2, the above scheme is also used to clean the image transferring device 6, as will be described hereinafter.

The device 6 is held i contact with the drum 2 except when the sheet S is nipped and conveyed. Hence, the trailing edge portion of the image area on the drum 2 is influenced by the transfer bias applied via the semiconductive roller of the device 6 which adjoins the trailing edge of the image area. In this condition, if toner not collected by the developing device 5 is present on the drum 2, it it likely that the toner is transferred to the device 6 by the transfer bias and then transferred to the rear of the next sheet S, thereby smearing it. In order to eliminate this problem, the embodiment controls the bias to be applied to the semiconductive roller, or transfer roller, such that the toner transferred to the roller is returned to the drum 2. In this sense, the device 6 performs self-cleaning.

FIG. 15 shows a specific self-cleaning procedure of the device 6. When the redeposition area of the drum 2 faces the transfer roller of the device 6, the device 6, like the cleaning device 7, reverses the direction of the electric field in the redeposition area. This successfully causes the entire toner to be transferred to the redeposition area of the drum 2 without regard to the polarity of the toner.

Figure 16:
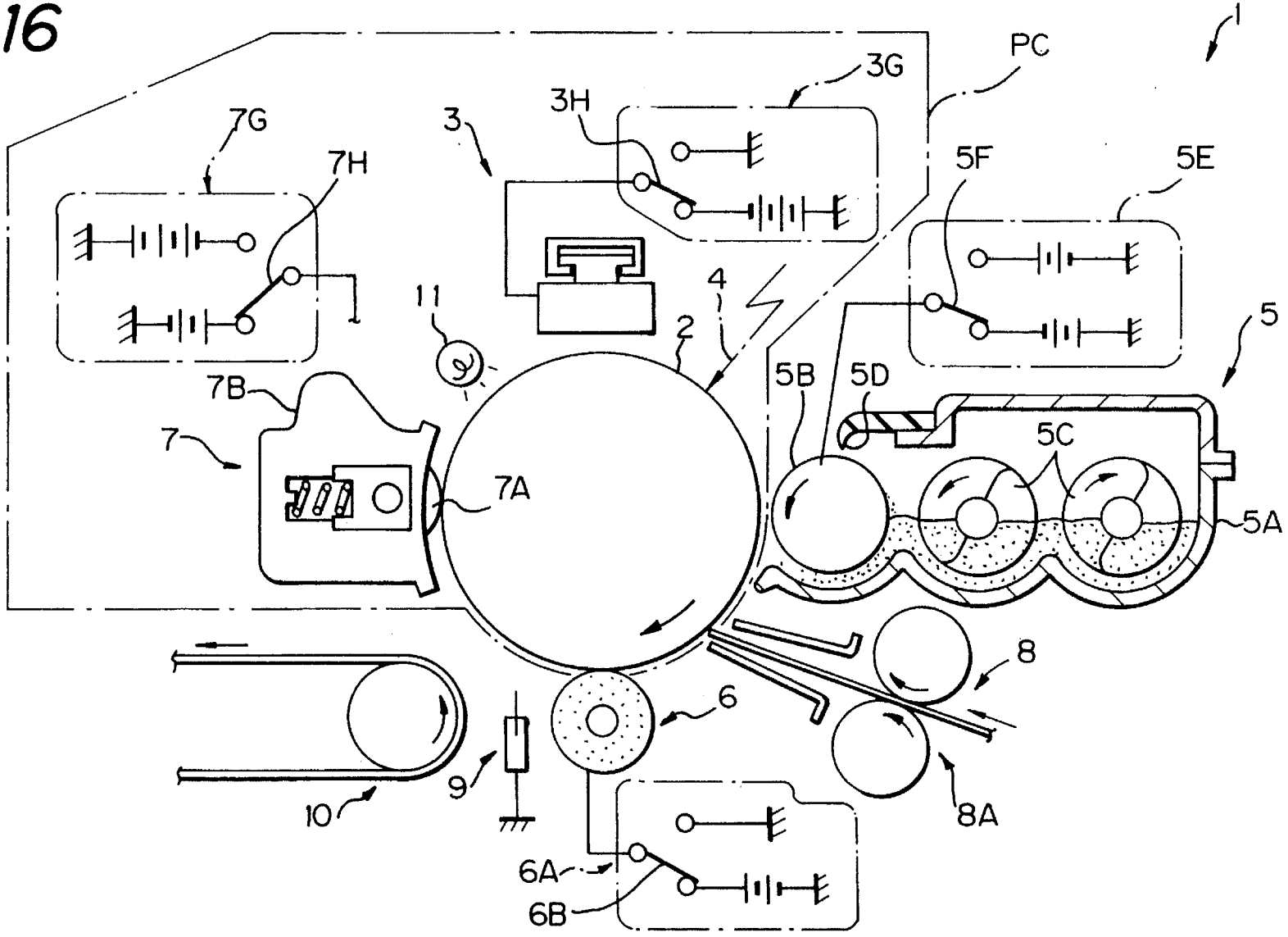
FIG. 16 is a fragmentary section showing a modification of the apparatus of FIG. 3.

The contact type charging device 3 shown in FIG. 3 may be replaced with a corona discharge type device or a needle electrode type device, as shown in FIG. 16. Also, the roller of the cleaning device 7 does not have to be movable, but it may be fixedly spaced apart from the drum 2 so long as it can contact the toner deposited on the drum 2 and perform charge injection. Further, changing the polarity of the bias to be applied to the cleaning roller, i.e., the direction of the electric field is only illustrative and may be replaced with setting the polarity and surface potential of the drum 2 in such a manner as to change the direction of the electric field.

Figure 17:
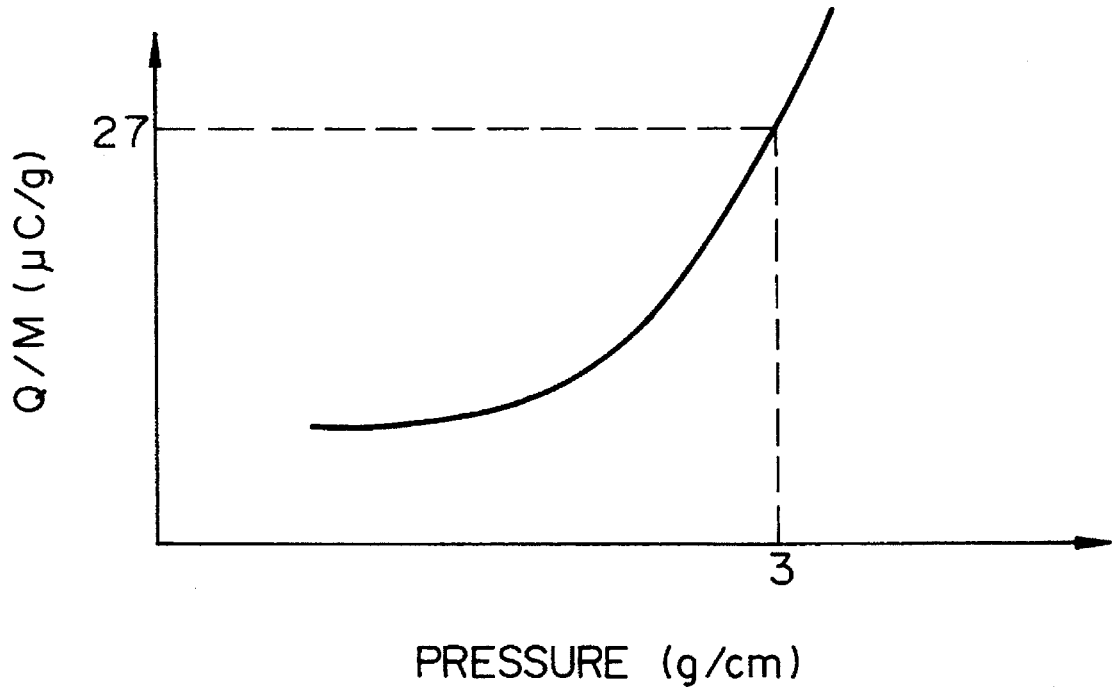
FIGS. 17 and 18 each shows a particular characteristic of a cleaning roller included in the cleaning device of FIG. 5.
Figure 18:
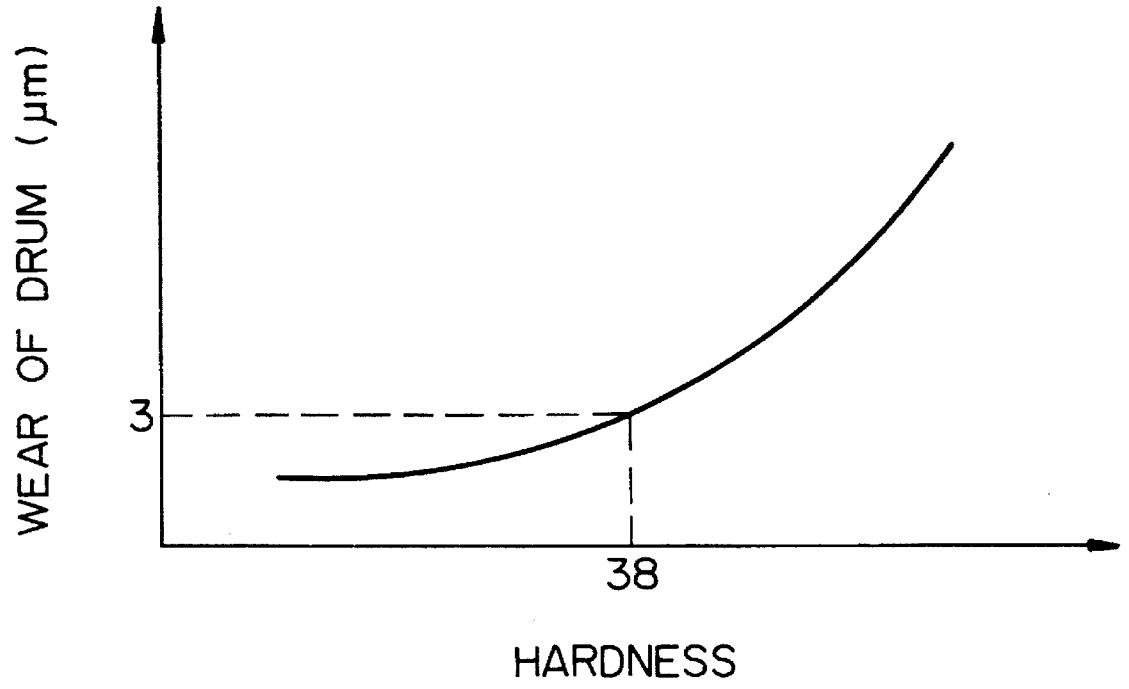

A third embodiment of the present invention will be described. In FIG. 3, the cleaning roller 7A is implemented as a conductive elastic member formed of rubber whose hardness is 20 degrees to 38 degrees, preferably 38 degrees, in terms of ASCA C. The roller 7A is pressed against the drum 2 by a pressure of 3 g/cm$^2$ and movable in the same direction as the drum 2, as viewed at the nip. As shown in FIG. 17, the pressure acting on the drum 2 is a critical value which allows, even when the nip is reduced, the toner to be sufficiently charged by friction and to the polarity which maximizes the attraction of the toner by the bias potential applied to the roller 7A. As shown in FIG. 18, the hardness of the roller 7A is a critical value which reduces the wear of the drum 2 attributable to the above pressure. Hence, even when a small nip is set without accelerating the wear of the drum 2, the toner attracted by the roller 7A can be uniformly charged to the preselected polarity and, therefore, desirably transferred to the roller 7A.

The roller 7A is movable in the same direction as the drum 2, as viewed at the nip. As to the linear velocity, the ratio of the rotation speed of the roller 7A to that of the drum 2 is selected to be less than 1. This allows the roller 7A to desirably rub the drum 2 at the nip and to sufficiently charge the toner by friction. In this condition, the entire toner remaining on the drum 2 can be charged to the same polarity, i.e., negative polarity at the nip. Moreover, the roller 7A is so configured as to attract the residual toner from the drum 2 onto the area less than its circumferential length. Therefore, the toner once deposited on the roller 7A does not face the image area of the drum 2 again.

With the above construction, the cleaning device 7 operates in the same manner as described with reference to FIGS. 10 and 11. The toner once deposited on the roller 7A does not reach the position where it would again face the image area of the drum 2 for the following reasons:

(1) The roller 7A is caused to contact the drum 2 when the print button is pressed, inclusive of the time when image formation begins with the first image area of the drum 2 corresponding to the image forming area;

(2) The roller 7A exerts a pressure of 3 g/cm$^2$ on the drum 2 because the roller 7A is assumed to move in the same direction as the drum 2 at the nip, and the linear velocity ratio is less than 1; and (3) The image area of the drum 2 as measured in the direction of rotation is less than the circumferential length of the roller 7A.

It follows that the trailing edge of the image area from which the toner has been transferred to the roller 7A does not face the toner of the roller 7A. This protects the toner deposited on the roller 7A from the influence of the charge potential of the image area of the drum 2 and thereby obviates the reverse transfer of the toner to the image area.

The roller 7A may have its circumferential length preselected in a particular relation to the image area of the drum 2, as follows. In the previous embodiments, the roller 7A is assumed to attract the toner from the image area of the drum 2 which is less than the circumferential length of the roller 7A. However, when the circumferential length of the roller 7A is simply used as a reference, the length of the image area in the direction of rotation of the drum 2 must be changed in accordance with the length of the latent image forming area in the above direction which is to join in the image transfer. In light of this, this embodiment provides the roller 7A with a circumferential length capable of containing the maximum length of the image area. Hence, when toner remaining in an image area short of the maximum image area is to be collected, the roller 7A can attract the entire toner and is prevented from returning it to the image area, without completing one full rotation.

Further, the amount of rotation of the roller 7A relative to the rotation speed of the drum 2 may be changed in order to attract the residual toner from the image area of the drum 2 in accordance with the length of the latent image forming area. This can be done if the sheet size, particularly its length in the direction of rotation of the drum 2, is sensed, and the rotation speed, i.e., the amount of rotation of the roller 7A is changed on the basis of the sensed size. Then, without regard to the length of the image area, i.e., whether the length be maximum or not, the roller 7A can attract the toner from the image area and is prevented from returning it to the image area, only if rotated in an amount smaller than its circumferential length, particularly smaller than one rotation.

In any of the embodiments, the drum 2 and roller 7A may be moved in opposite directions to each other, as viewed at the nip, in order to charge the toner by friction. In this case, the roller 7A is formed of rubber whose hardness is 20 degrees to 38 degrees, preferably 38 degrees which minimizes the wear of the drum 2, as shown in FIG. 18. The roller 7A is pressed against the drum 2 by a pressure of 3 g/cm$^2$. These specific values are also selected for the previously stated reasons.

The ratio of the rotation speed of the roller 7A to that of the drum 2 is not limited to less than 1, but it may be 1. The roller 7A is rotated such that it moves in the opposite direction to the drum 2 at the nip. This configuration intensifies the friction acting on the toner at the nip and thereby promotes the efficient charging of the toner. When the length of the image area is far smaller than the circumferential length of the roller 7A, the speed ratio of the roller 7A to the drum 2 may be selected to be greater than 1 in order to enhance efficient frictional charging. The prerequisite is, of course, that the roller 7A attracts the toner from the image area of the drum 2 which is short of the circumferential length of the roller 7A.

As stated above, even when the nip is reduced, the embodiment satisfies the conditions necessary for frictional charging, particularly those for charging the toner to the same polarity. Because the attraction of the toner from the image area of the drum 2 is effected in an area short of the circumferential length of the roller 7A, the toner collected by the roller 7A is prevented from being returned to the image area and, therefore, from being influenced by the bias remaining in the image area.

In the illustrative embodiments, the drum 2 and roller 7A are rotated such that they move in the same direction at the nip. Originally, this is to charge the residual toner on the drum 2 to the same polarity by friction which is derived from the difference in peripheral speed between the drum 2 and the roller 7A. In practice, however, not all the toner is charged to the same polarity, but the toner is simply regularized as to the overall tendency of polarity. The residual toner, therefore, includes particles charged to the opposite polarity to the frictional charge and even particles having no polarity, i.e., non-friction particles. Although the roller 7A mechanically removes the residual toner from the drum 2 at the nip, the particles of opposite polarity and non-friction particles are inversely transferred to the drum 2 due to the electrostatic force acting at the nip, resulting in defective cleaning.

The defective cleaning is attributable to the directions of rotation of the drum 2 and roller 7A, i.e., to the fact that the toner deposited on the roller 7A moves in the same direction as the drum 2 while facing the surface of the drum 2. In order to obviate the defective cleaning, the roller 7A is caused to move in the opposite direction to the drum 2 at the nip. Then, as shown in FIG. 7, the surface of the drum 2 from which the toner has been transferred to the roller 7A does not face the toner of the roller 7A again. This prevents the toner from being reversely transferred from the roller 7A to the drum 2.

Figure 19D:
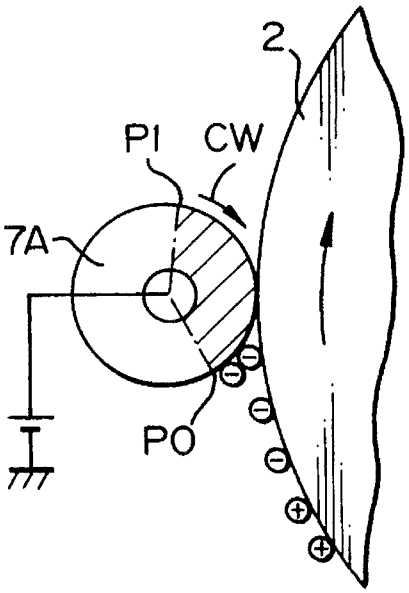
FIGS. 19A–19D are views indicative of a problem attributable to a relation between a cleaning roller and an image carrier included in an image forming apparatus.
Figure 19C:
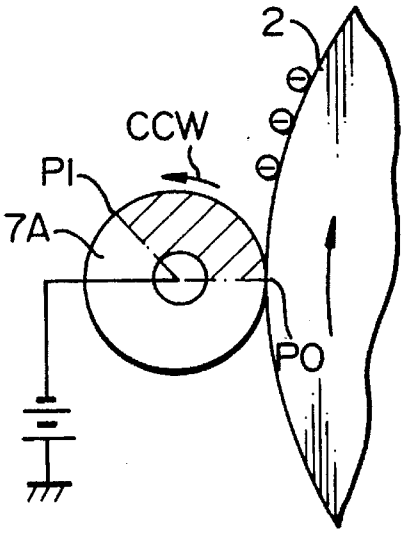
Figure 19B:
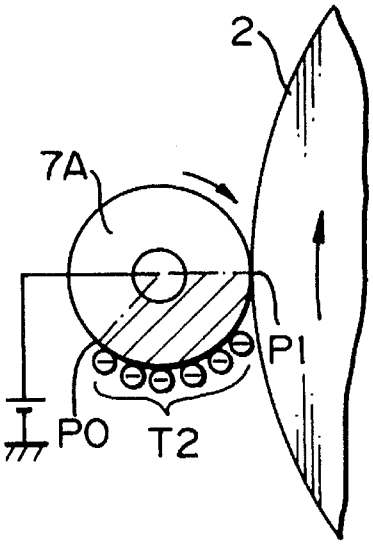
Figure 19A:
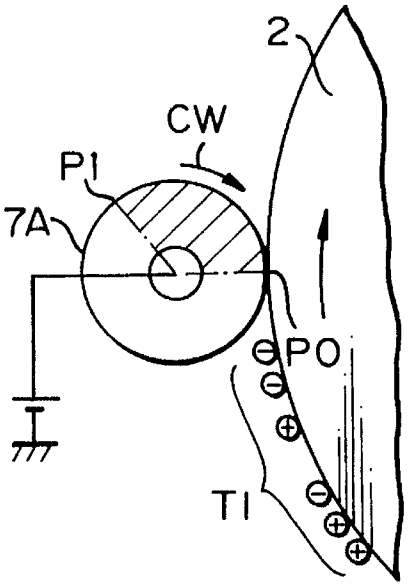

However, when the roller 7A is rotated in the above direction and when the attraction of the residual toner and the following redeposition on the drum 2 are repeated over a length smaller than the circumferential length of the roller 7A, the toner to be collected by the roller 7A is partly left on the drum 2. This will be described with reference to FIGS. 19A–19D which demonstrate the toner collection and redeposition to occur over a length smaller than the circumferential length of the roller 7A. Assume that the area of the roller 7A for depositing the toner transferred from the drum 2 is one-third of the circumferential length. As shown, when the roller 7A attracts the toner from the drum 2 while moving in the opposite direction (clockwise or CW) to the drum 2 at the nip, the bias for attraction is applied to the roller 7A. In this case, the bias is of positive polarity. As a result, as shown in FIGS. 19A and 19B, toner T1 remaining on the drum 2 is transferred from the drum 2 to the limited area of the roller 7A between points P1 and P0 and indicated by hatching. The toner on the roller 7A is labeled T2.

To redeposit the toner on the drum 2, the roller 7A is moved in the same direction as the drum 2 at the nip (counterclockwise or CCW). Consequently, as shown in FIG. 19C, the toner existing in the area P1–P0 of the roller 7A is applied with a bias of the polarity causing it to repulse the roller 7A and is redeposited on the drum 2 thereby.

When the redeposition on the drum 2 is completed, the point P0 of the roller 7A which has initially faced the drum 2 again faces it. If cleaning is repeated in this condition, the area P0–P1 of the roller 7A is again used to attract residual toner from the drum 2, i.e., it again faces the drum 2. As a result, the local wear of the roller 7A occurs in the circumferential direction of the roller 7A, lowering the cleaning efficiency.

Figure 20A:
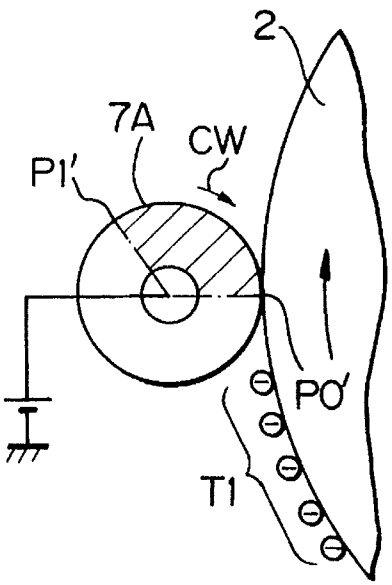
FIGS. 20A–20D are views showing a relation between a cleaning roller included in the cleaning device of FIG. 3 and the image carrier.
Figure 20B:
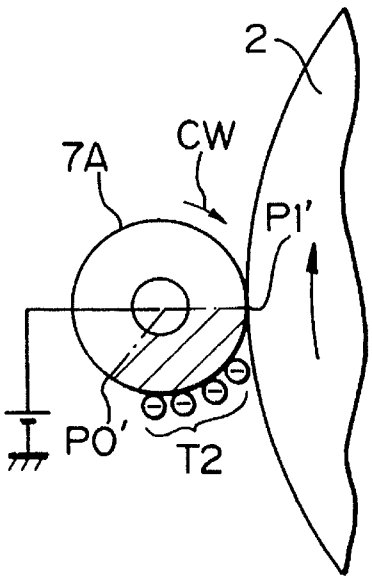
Figure 20C:
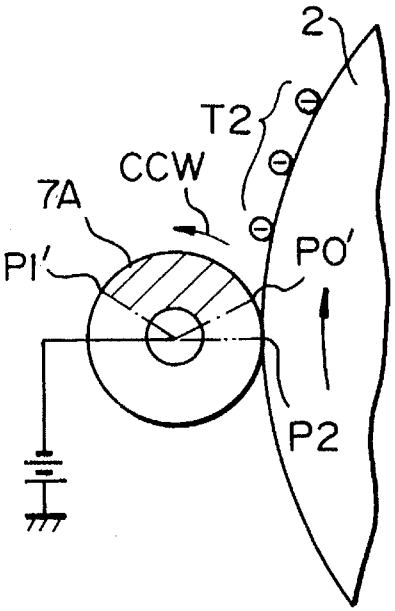
Figure 20D:
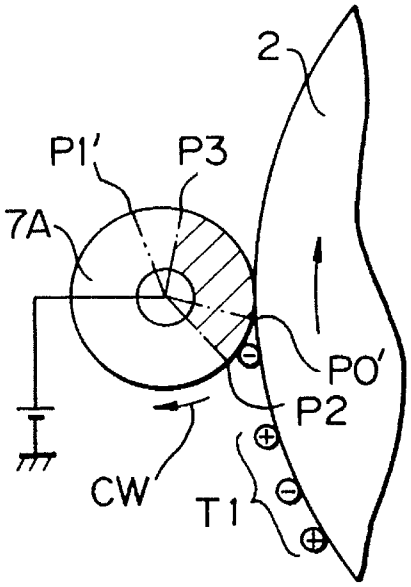

In light of the above, the embodiment causes the roller 7A to rotate in a particular amount for each of the toner attraction and toner redeposition, as will be described with reference to FIGS. 20A–20D. In FIGS. 20A–20D, the roller 7A is rotated in the same directions as in FIGS. 19A–19D. Initially, the roller 7A is positioned such that a point P0' thereof faces the drum 2 (FIG. 20A). In the event of attraction, the area of the roller 7A extending from the point P0' to a point P1' sequentially faces the drum 2, as shown in FIG. 20B. The toner deposited on the roller 7A is labeled T2. As shown in FIG. 20C, to release the toner, the roller 7A is moved until a point P2 faces the drum 2. The distance between the points P1' and P2 is greater than the distance between the points P'1 and P0'. As shown in FIG. 20D, for the next attraction, the roller 7A is moved from the position P2 over a length corresponding to the initial length P0'–P1' (P0~P1'=P2~P3). As a result, the position of the roller 7A to face the drum and where the attraction begins is sequentially shifted. This successfully protects the roller 7A from local wear.

With the above arrangement, the embodiment uniformizes the wear of the roller 7A in the circumferential direction and protects the roller 7A from local wear. Therefore, the life of the roller 7A is extended to ensure the cleaning effect.

A fourth embodiment of the present invention will be described hereinafter which allows residual toner to be removed when image formation once interrupted is resumed. First, how the reverse transfer of toner occurs in the event of a trouble brought about in the image forming apparatus. While the amount of residual toner slightly changes even during ordinary image formation, it changes noticeably (1) when a sheet jam occurs, (2) when a sheet of size A4 is used with a document of size A3, and any toner is input to the cleaning section without being transferred to the sheet, and (3) when the amount of residual toner increases due to the fall of the transfer efficiency which is attributable to a thick sheet or a change in environment.

Figures 21A, 21B, 21C, 21D, 21E, 21F:
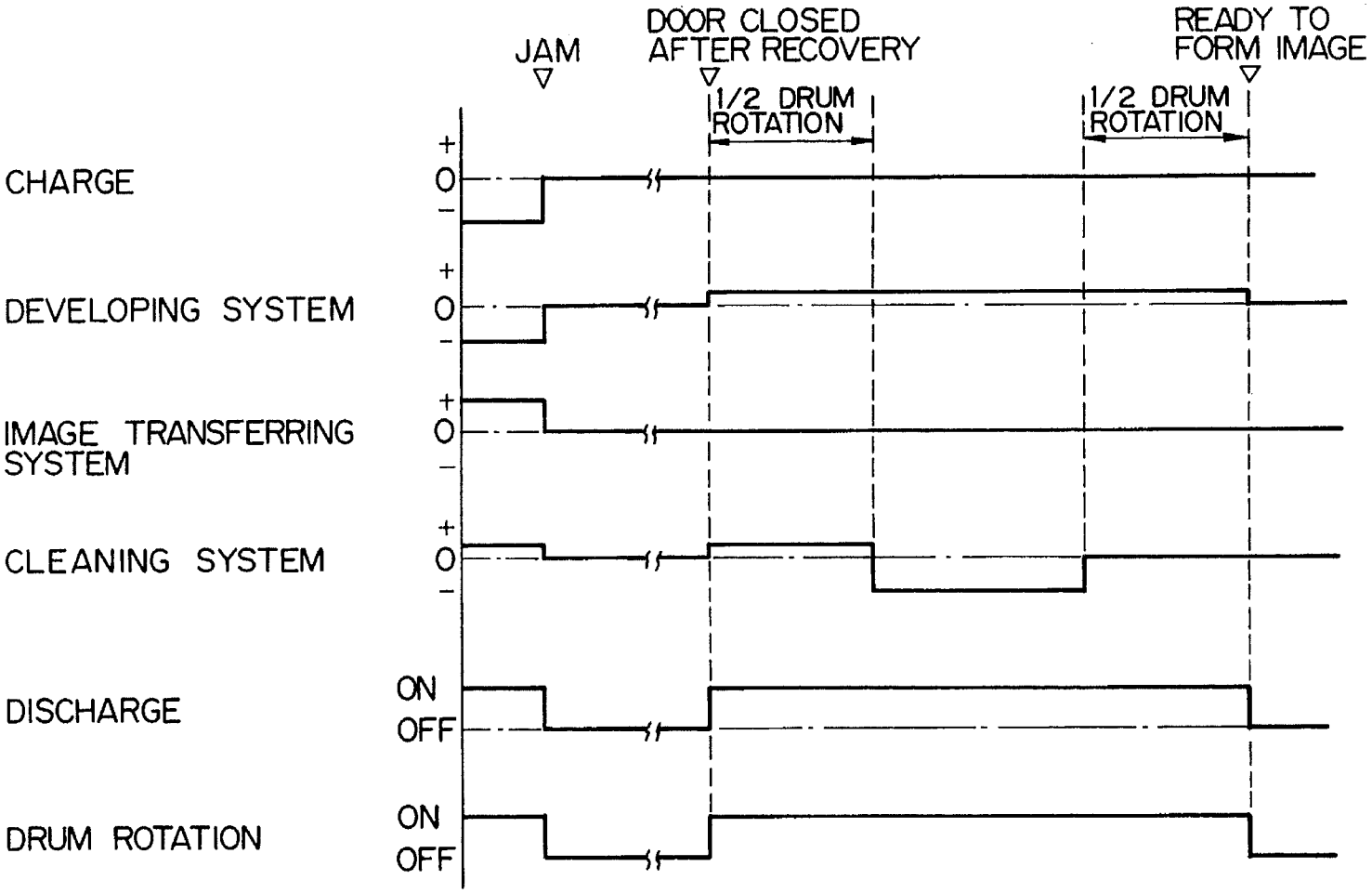
FIG. 21 is a timing chart representative of a procedure to be executed by the apparatus of FIG. 3 after a sheet jam.

FIG. 21 is a timing chart representative of a procedure to follow a sheet jam which is a specific trouble. In the event of a jam, a sensor, not shown, senses it, causes the apparatus to stop operating, and turns off the power source. After the jamming sheet has been removed, the apparatus is reset and caused to start up again. On the other hand, a non-transferred toner image is left on a photoconductive drum between the developing position and the image transferring position or between the developing position and the cleaning position when the apparatus has stopped operating, depending on the position where the jam occurred. If the image formation is resumed in the above condition, the toner image reaches the cleaning position. Then, because the amount of toner is excessive, the roller 7A fails to remove all the toner. As a result, the toner is partly passed through the cleaning position to the downstream side. When use is made of the charge roller 3A or similar contact type charger, this part of the toner smears it and causes white stripes to appear in an image. In order to avoid this, the toner image must be removed from the drum 2 before the next image forming cycle begins.

As shown in FIG. 21, when the power source of the apparatus is again turned on after the jam, the drum 2 again starts rotating. The previously mentioned voltage of +300 V is applied to the roller 7A in order to remove the toner from the drum 2. The discharge lamp 11 is turned on (ON). The charge roller 3A is moved away from the drum 2. A developing bias of +150 V is applied. No voltages are applied to the transfer roller 6 (OFF). In this condition, the toner image is removed from the drum 2. Although most of the toner constituting the toner image is removed, more toner remains on the drum 2 than usual and moves away from the roller 7A. The toner moved away from the roller 7A is collected by the developing section because it has been charged to the negative polarity by development. After the developed portion of the drum 2 has moved away from the roller 7A (about half a rotation of the drum 2), the voltage control means of the power source 7G applies to the roller 7A a voltage (e.g. −800 V) capable of forming a more intense electric field for reverse transfer than usual. As a result, all the toner greater in amount than usual is transferred from the roller 7A to the drum 2 and then collected by the developing roller 5B.

Figure 22:
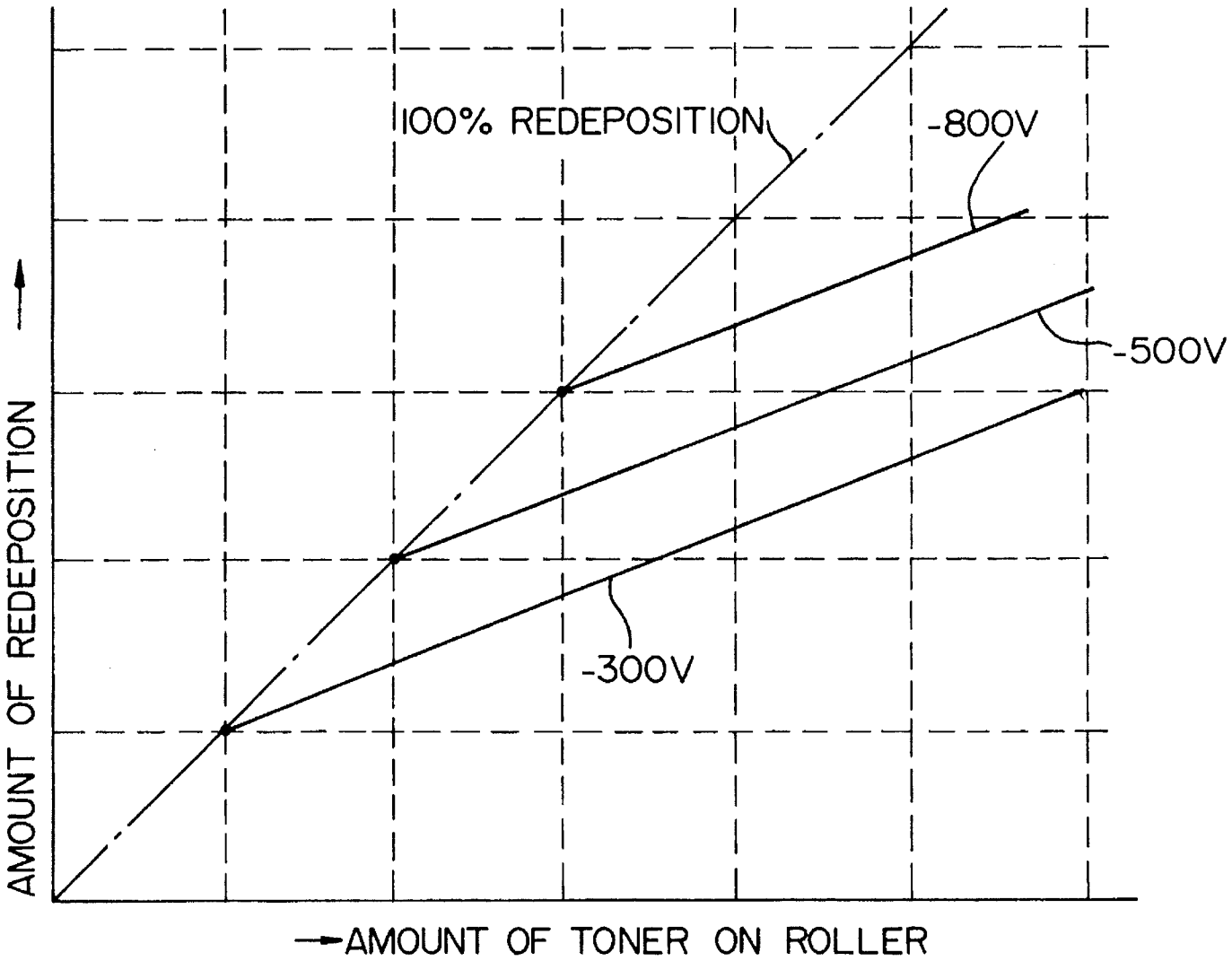
FIG. 22 shows a relation between the amount of toner deposited on the cleaning roller and the amount of redeposition on the photoconductive element by using a voltage as a parameter.

FIG. 22 shows a relation between the amount of toner held by the roller 7A and the amount of reverse transfer to the drum 2. As shown, the electric field must be intensified with an increase in the amount of toner on the roller 7A. Generally, the drum 2 begins to be charged by the application of a voltage ranging from 450 V to 500 V due to discharge. When a voltage of −800 V is applied to the roller 7A, the drum 2 is charged to −400 V. In principle, therefore, even the usual voltage to be applied to the roller 7A should only be −800 V matching the possible maximum amount of toner to reach the roller 7A. However, because the drum 2 is charged to −400 V in the event of reverse transfer, this potential must be dissipated. As a result, the drum 1 suffers from electrostatic fatigue and has its life reduced. By contrast, just after the turn-on of the power source following the removal of a jam or similar trouble, the embodiment applies an electric field (−800 V) more intense than the usual electric field for image formation (−500 V) to the roller 7A at the time of the redeposition of toner on the drum 2. Hence, the charge of the drum 2 in the event of usual reverse transfer is as low as about 0 V to 5 V and frees the drum 2 from electrostatic fatigue.

The embodiment, therefore, minimizes the electrostatic fatigue of the drum 2 and extends the life of the drum 2 without lowering the toner removing ability even when an unusual amount of toner is input.

Another control means available with the illustrative embodiment is as follows. On the elapse of a predetermined period of time after the stop of operation, the roller 7A is caused to redeposit the toner on the drum 2, and the voltage control means for the roller 7A is implemented as an electric field more intense than the voltage control means for image formation. Specifically, a voltage higher than the voltage applied to the roller 7A from the power source 7G during image formation is applied to the roller 7A, so that the toner is redeposited on the drum 1 by a more intense electric field than during usual image formation. Hence, even when an unusual amount of toner occurs, e.g., when a sheet of size A4 is used with a document of size A3, all the toner deposited on the roller 7A can be returned to the drum 2 and then collected by the developing roller 5. This prevents the cleaning ability of the roller 7A from decreasing while preventing the life of the drum 1 from being reduced.

Further control means available with the embodiment will be described. Every time a predetermined number of copies have been produced, voltage control means capable of generating a more intense electric field than usual causes the roller 7A to redeposit the toner on the drum 2. Specifically, once for every predetermined number of copies, a voltage higher than the voltage applied from the power source 7G to the roller 7A during image formation is applied to the roller 7A. As a result, the toner is returned to the drum 2 by a more intense electric field than usual. Hence, all the toner can be redeposited on the drum 2 even when the amount of residual toner increases due to the fall of transfer efficiency which is attributable to, e.g., a thick sheet or a change in environment. This successfully preserves the ability of the roller 7A and insures the expected life of the drum 2.

In the embodiment, the electric field for cleaning and the electric field for redeposition are implemented by changing the bias voltage to be applied to the roller 7A. Alternatively, an arrangement may, of course, be made such that while the bias voltage is maintained constant, the drum 2 is inverted in polarity by a transfer roller or similar transfer charger in the event of redeposition.

A fifth embodiment of the present invention will be described hereinafter. In this embodiment, the roller 7A is moved into and out of contact with the drum 2 under the following conditions. First, when image formation is not effected with the drum 2, the roller 7A is spaced from the drum 2. Second, before image formation using the drum 2, the drum 2 is rotated in the direction opposite to the direction assigned to image formation, and then the roller 7A is brought into contact with the drum 2. Third, the roller 7A is caused to contact the drum 2 before the drum 2 starts rotating forward at the beginning of image formation.

Figures 23A, 23B, 23C, 23D, 23E, 23F, 23G:
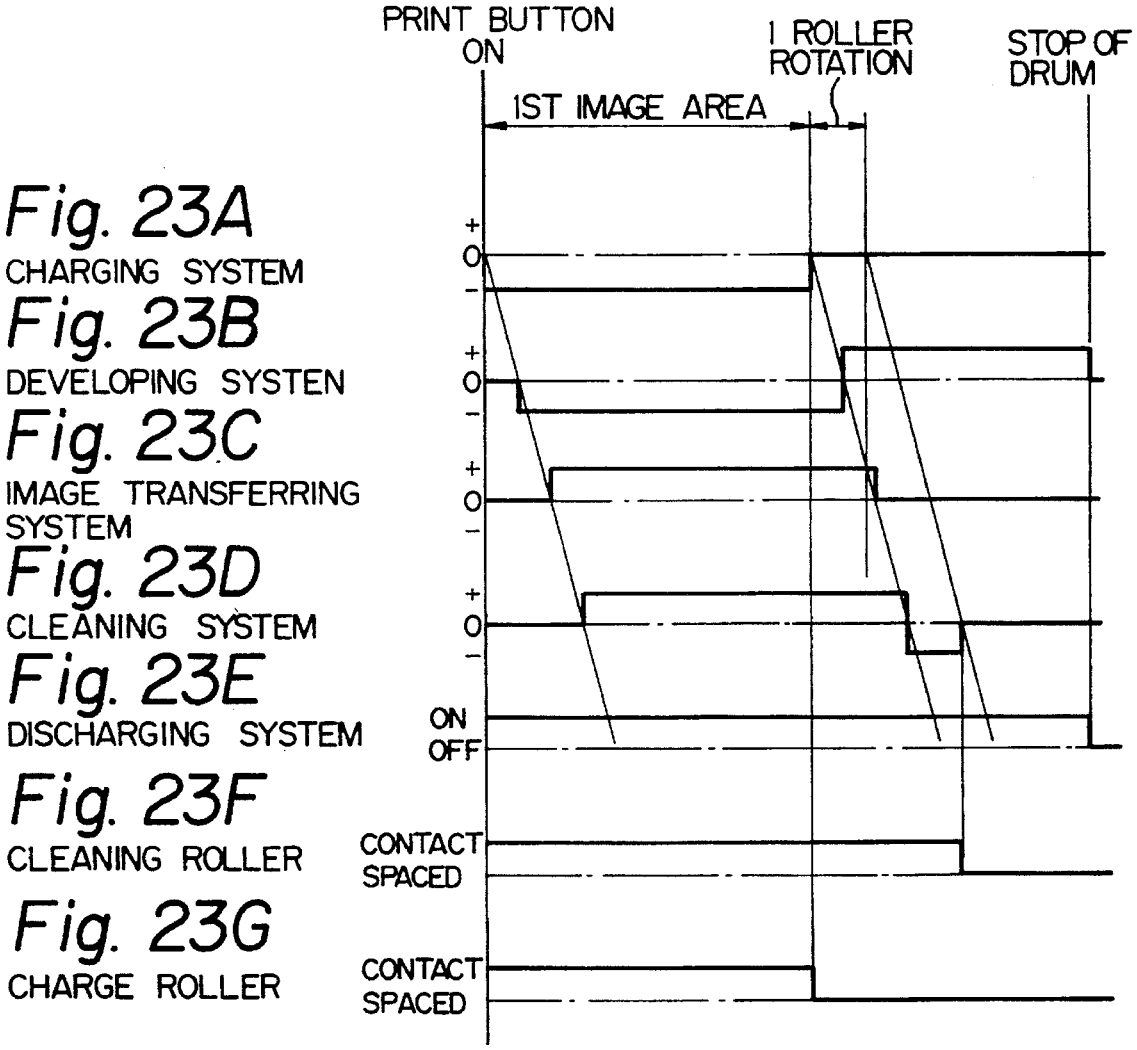

With the above construction, this embodiment is also operated in the manner shown in FIG. 10. The roller 7A is moved away from the drum 2 after the redeposition of the toner on the drum 2. At this instant, as shown in FIG. 23, the roller 7A may be moved away from the drum 2 at the same time as the application of the voltage for redeposition ends. In this case, the switch H of the power source 7G is held in its neutral position in order to stop the application of the voltage for redeposition. When the roller 7A is separated from the drum 2 simultaneously with the end of redeposition, the drum 2 is free from the electrostatic influence. In addition, even if some toner is left on the roller 7A, it is prevented from depositing on the drum 2 and contaminating the background of the drum.

Figures 24A, 24B, 24C, 24D, 24E, 24F, 24G:
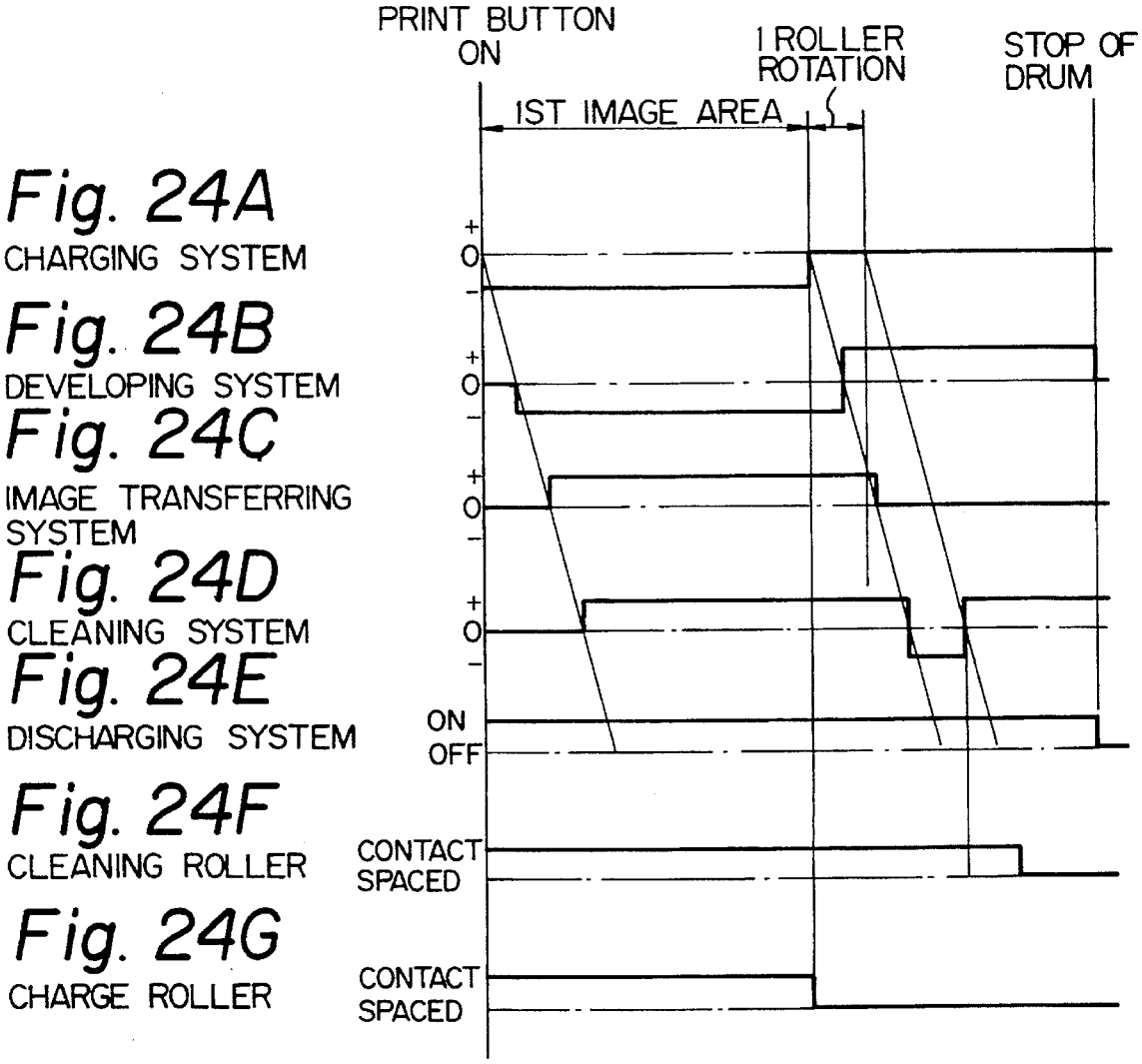

FIG. 24 shows a modification of the embodiment and relating to the application of voltages to the roller 7A. As shown, when the rotation of the roller 7A for collecting the toner from the drum 2 ends, +300 V is applied to the roller 7A in place of −500 V. In this case, the roller 7A is also separated from the drum 2 after the polarity inversion for redeposition, as shown in FIG. 10. Consequently, even when the toner redeposited on the drum 2 is partly positioned in the image area by accident, it can be collected by the roller 7A. This frees the background of the drum 2 from contamination.

Figures 25A, 25B, 25C, 25D, 25E, 25F, 25G:
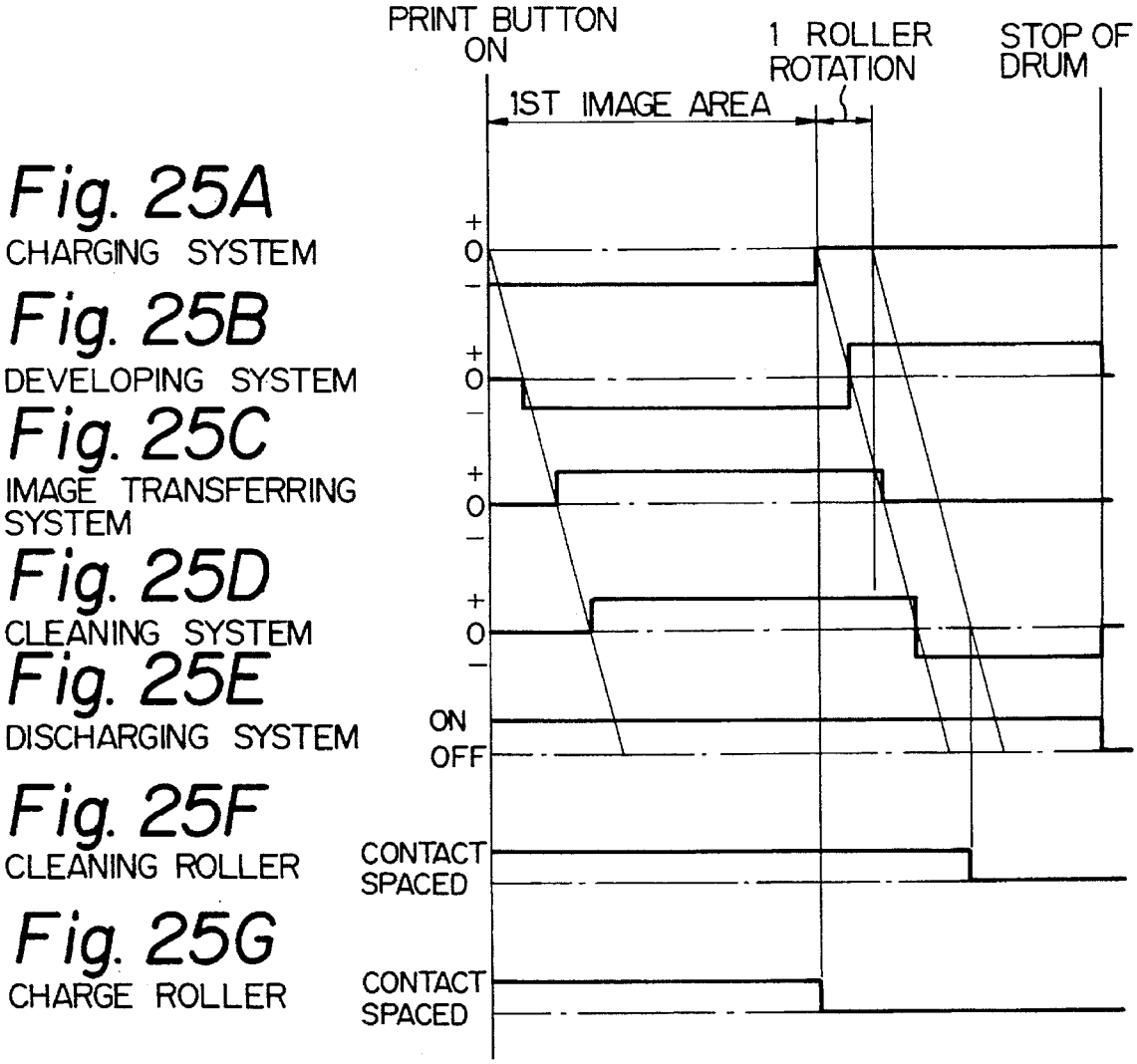

Further, assume the interval between the image formation on the drum 2 and the collection of the developer, i.e., between the charging and the collection of the residual toner in by the charging device 5. Then, as shown in FIG. 25, the voltage for redeposition may be continuously applied to the roller 7A from, in the above interval, the time of redeposition to the time when the movement of the drum 2 ends. In this case, the roller 7A may be moved away from the drum 2 during the continuous application of the voltage. As a result, the charge potential of the image area remains negative in polarity until the separation of the roller 7A from the drum 2. This is to set up a negative charge tendency when the drum 2 has an OPC or similar organic photoconductive layer, so that the optical discharging effect available with the discharging device 11 is enhanced. Consequently, the drum 2 can be uniformly charged by the charger 3 at the time of the next image formation.

Now, assume that the roller 7A is rotated at a speed close to the speed of the drum 2, but not obstructing frictional charging, in the event when it attracts the residual toner from the drum 2. Then, the time up to the collection of the toner by the developing device 5, of course, increases. This increases the waiting time up to the next copying operation and is apt to obstruct high-speed copying. In order to obviate this drawback, the moving speed of the roller 7A is increased relative to the moving speed of the drum 2. Specifically, as shown in FIG. 26, the peripheral speed of the roller 7A, corresponding to the moving speed, is selected such that the roller 7A makes two rotations ($n \geqq 1$) in the redeposition area of the drum 2. Then, the chance that the roller 7A faces the drum 2 increases. As a result, the period of time necessary for the toner to be returned to the drum 2 is reduced. Hence, as shown in FIG. 27, in the sheet feeding step for the next image formation (sheet interval), the period of time necessary for the redeposition of the toner on the drum 2 is reduced and, in turn, reduces the interval between the consecutive image forming cycles.

Image formation is sometimes interrupted by a sheet jam or similar trouble. Then, when the apparatus is again started up after recovery, the image area of the drum 2 is likely to correspond to a position short of the image transferring device 6 or the cleaning device 7, as at the time of start-up or warm-up. When the apparatus is again started up in such a condition, the drum 2 is cleaned for initialization. In this case, because the toner remaining on the drum 2 includes the toner left non-transferred due to the interruption of operation, the cleaning device 7 is likely to remove the toner from the drum 2 in a greater amount than at the time of usual cleaning. Hence, when the toner collected by the roller 7A is to be redeposited on the drum 2, the redeposition ratio changes with a change in the bias voltage, a shown in FIG. 22. For this reason, sure redeposition is not achievable without resorting to a high voltage. The high voltage, however, increases the potential to remain on the drum 2 and, therefore, the potential for dissipating it. In this case, the dissipating potential corresponds to the amount of light from the discharging device 11. It follows that the drum 2 suffers from noticeable electrostatic fatigue attributable to the application of high voltages to the roller 7A for attraction and redeposition as well as to the repeated discharge. This is apt to reduce the life of the drum 2.

Figures 28A, 28B, 28C, 28D, 28E, 28F:
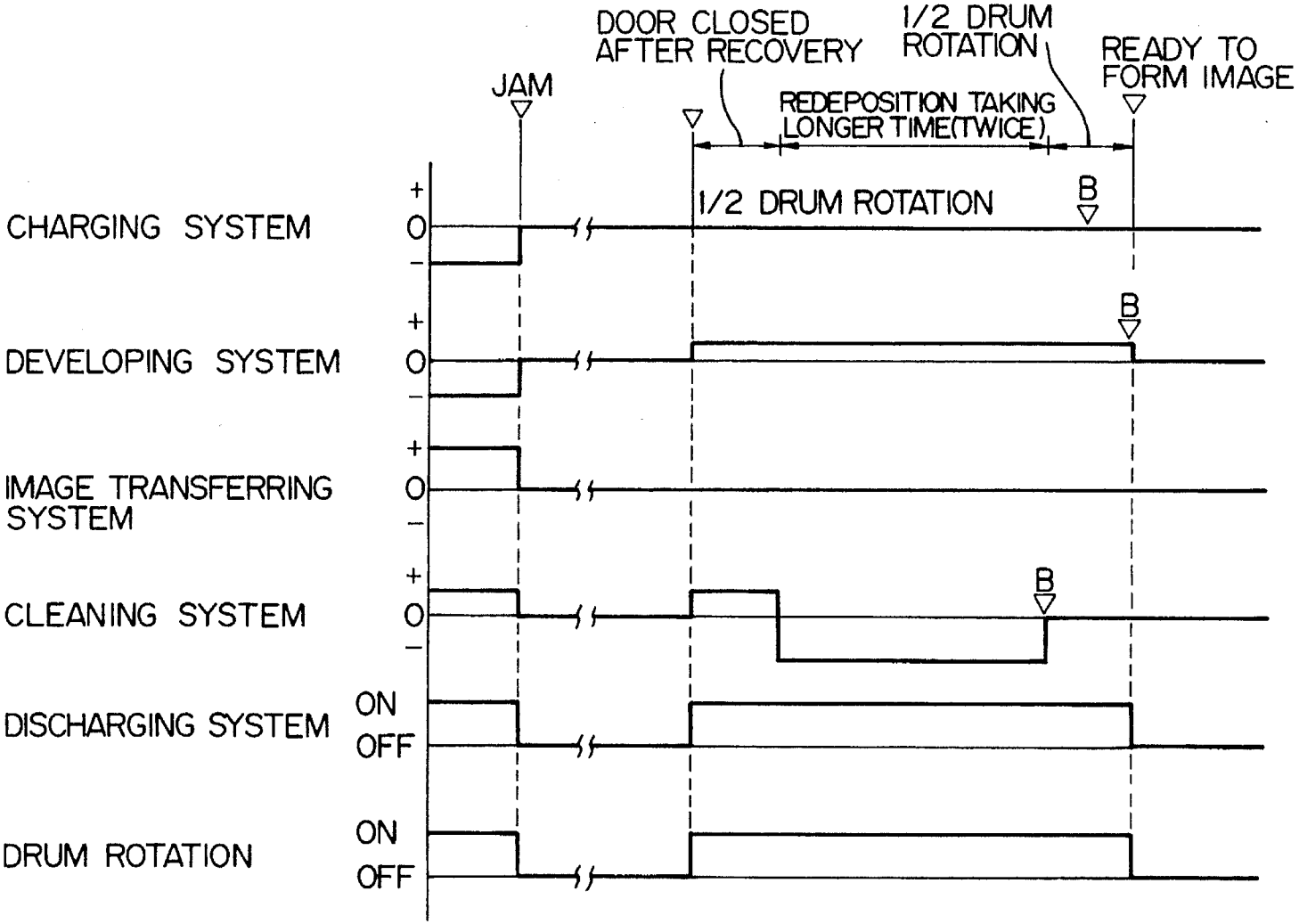

As shown in FIG. 28, the illustrative embodiment does not increase the voltages to be applied to the roller 7A, but it increases the period of time necessary for the redeposition of the toner on the drum 2 to complete, thereby reducing the electrostatic fatigue of the drum 2. FIG. 28 shows a specific procedure wherein the apparatus is restarted after the removal of a jamming sheet. When a jam occurs, the various sections of the apparatus stop operating. Foe example, the biases to the devices including the charging device are interrupted. After a jamming sheet has been removed, a door mounted on the apparatus is closed. Then, the drum 2 again starts rotating, and the biases are applied to the various devices except for the charging device 2. That is, the bias of the polarity necessary for the collection of toner is applied in the developing device, while the bias of the polarity necessary for the attraction of the bias from the drum 2 and the bias of the polarity necessary for the redeposition on the drum are applied in the cleaning device 7. It is to be noted that the discharging device 11 executes discharging from the time when the drum 2 starts rotating to the time when it becomes ready to form an image thereon, as in the previous embodiment.

In FIG. 28, on the restart of rotation of the drum 2, the cleaning device 7 collects the toner from the image area of the drum 2. Subsequently, the toner is redeposited on the drum 2 when the image area of the drum 2 has moved a distance corresponding to one rotation of the roller 7A. The period of time necessary for this redeposition is selected to be longer than the duration of usual redeposition; in the embodiment, the former is twice as long as the latter. The bias voltage to be applied to the device 7 is selected to be the same as the voltage which is applied during the course of ordinary image formation.

The illustrative embodiment applies to the roller 7A a bias for the redeposition and equal to the bias usually applied to the same for cleaning. The embodiment, therefore, prevents the electrostatic fatigue of the drum 2 from being aggravated and allows the entire toner to be returned from the roller 7A to the drum 2.

Figures 29A, 29B, 29C, 29D, 29E, 29F, 29G, 29H:
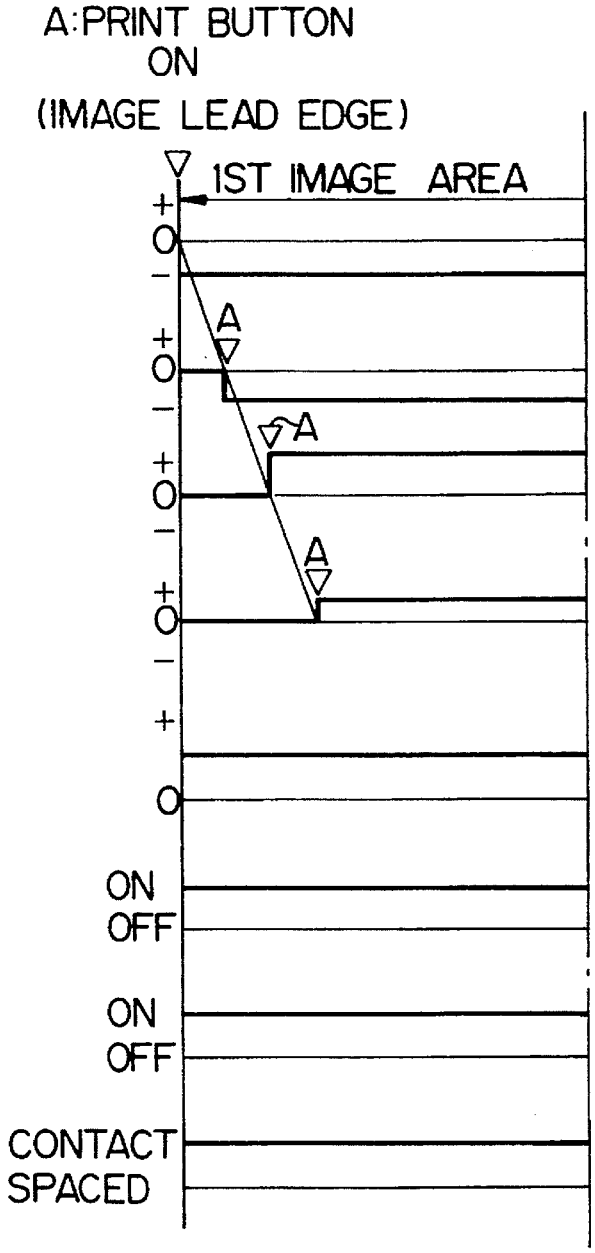
Figures 29I, 29J, 29K, 29L, 29M, 29N, 29O, 29P:
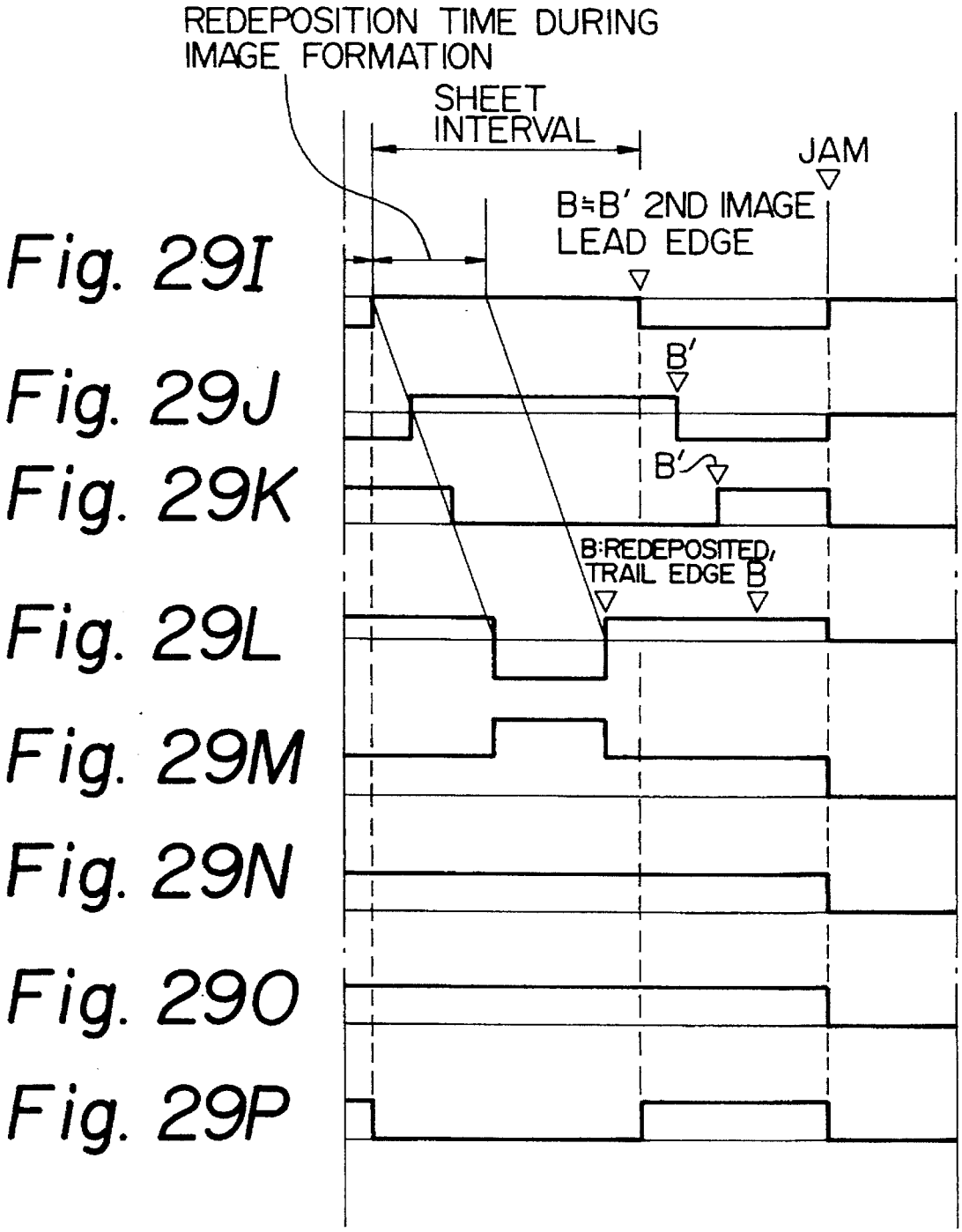
Figures 29Q, 29R, 29S, 29T, 29U, 29V, 29W, 29X:
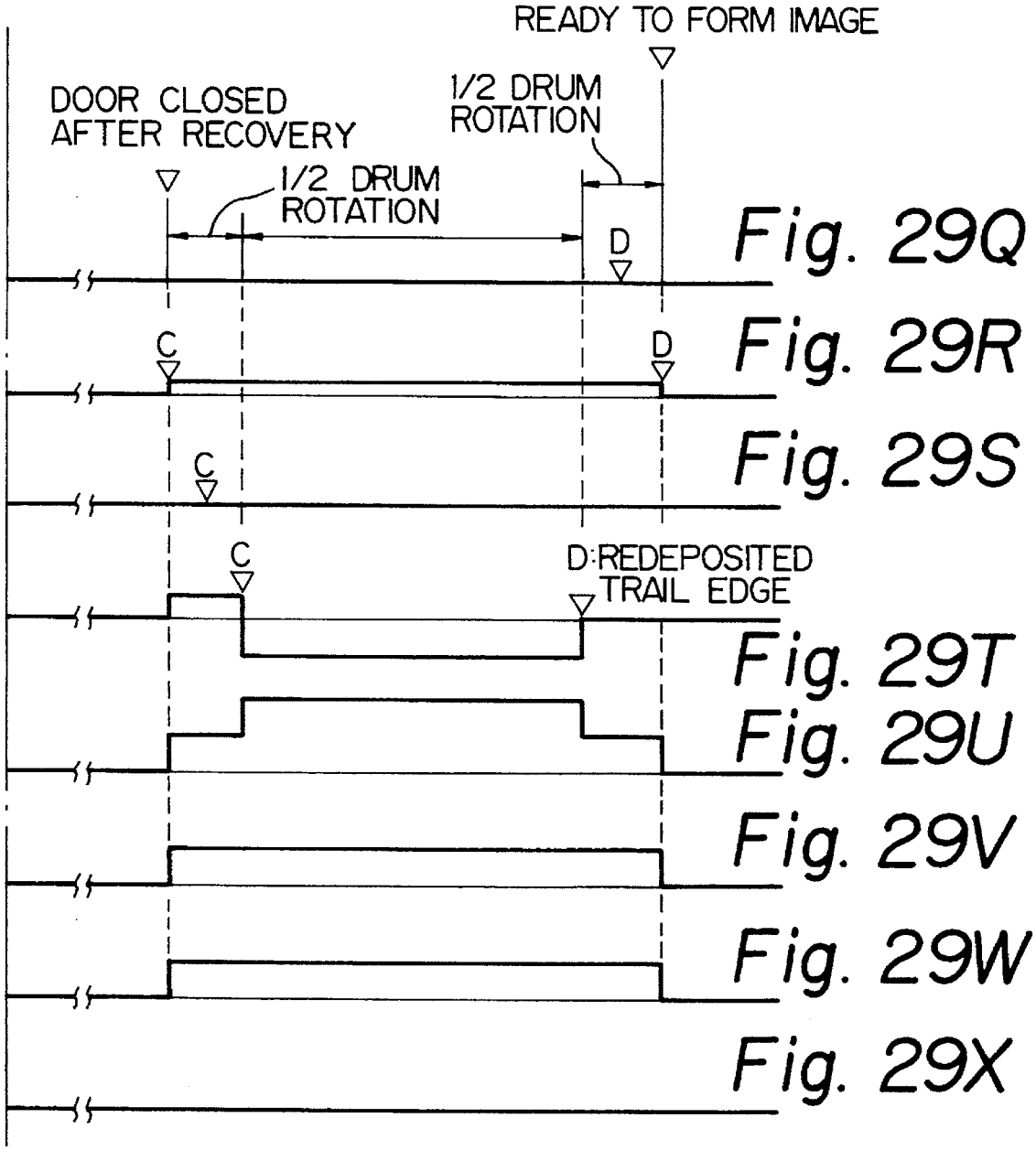

FIG. 29 shows a specific procedure wherein a plurality of (two) sheets are sequentially fed, and a jam occurs in the second image area of the drum 2. The procedure of FIG. 29 will not be described in detail because the collection of toner and the initialization of the drum 2 are effected in the same manner as described with reference to FIG. 28.

Generally toner is apt to sequentially accumulate on the photoconductive layer of a photoconductive drum. This kind of toner accumulation is usually referred to as filming. Should toner accumulate on the drum more than necessary due to filming, it would lower the charging ability and obstruct the formation of a latent image and would even reduce the life of the drum. The illustrative embodiment further includes a measure against filming, as follows. Only for a preselected period of time, the roller 7A is rotated at a higher speed than during the usual attraction and redeposition of toner. This intensifies the friction acting between the roller 7A and the drum 2 and thereby removes the toner accumulated on the drum 2.

Figures 30A, 30B, 30C, 30D, 30E, 30F, 30G:
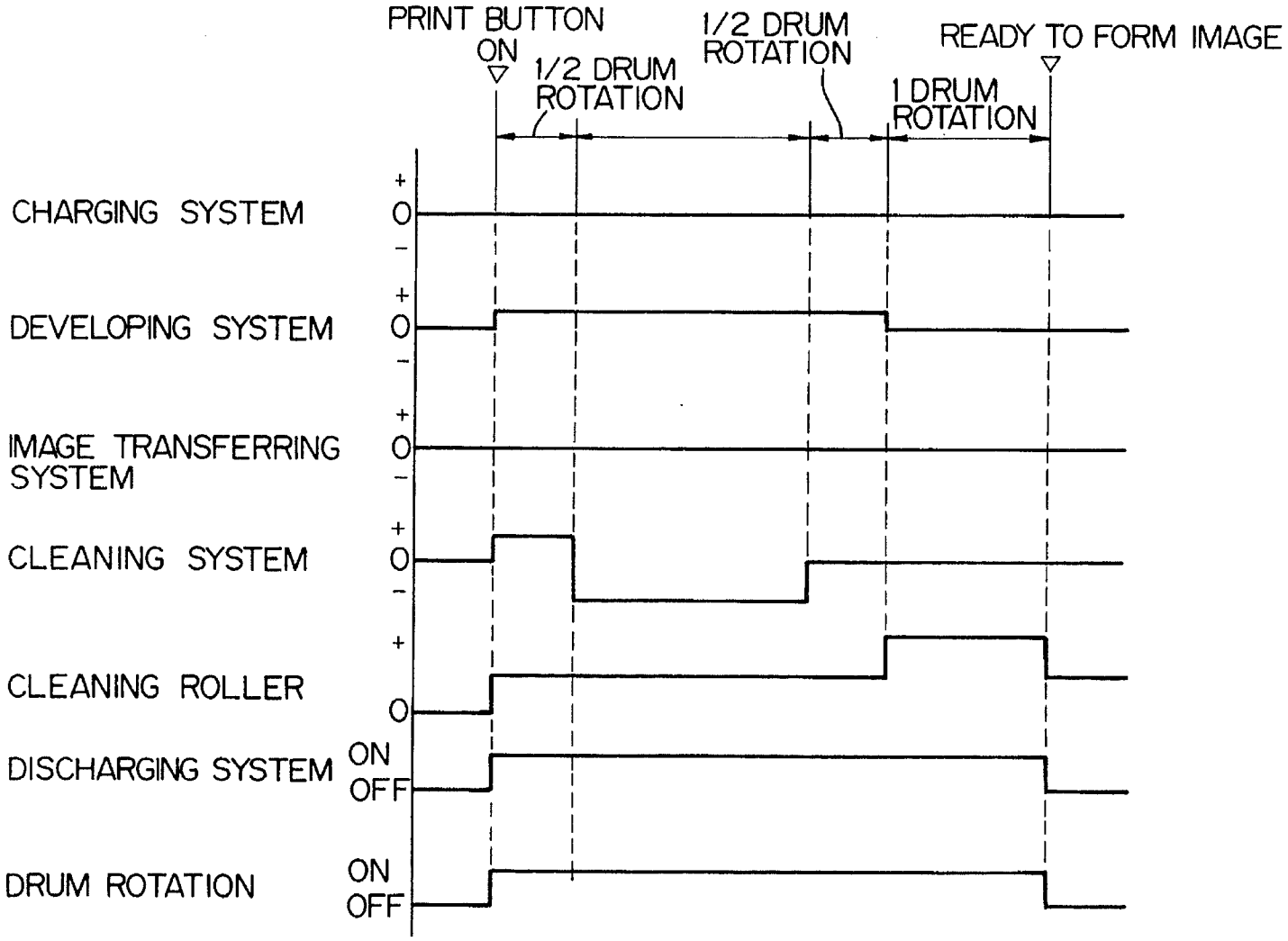

Specifically, as shown FIG. 30, when the image forming apparatus is switched on, the polarity of the bias voltage to the roller 7A for the attraction and redeposition of toner is inverted, thereby initializing the drum 2. As soon as the inversion of the polarity ends, the roller 7A is caused to make one rotation at a higher speed. As a result, the roller 7A scrapes off the toner accumulated on the drum 2 by friction Referring to FIG. 31, a modification of this embodiment will be described which provides the drum 2 and roller 7A with a unique relation. As shown, when the print button is pressed (ON), the drum 2 is rotated in the direction opposite to the direction assigned to image formation. The amount of reverse rotation of the drum 2 is selected to be greater than an amount corresponding to the nip length shown in FIG. 7, as measured in the circumferential direction of the drum 2. Hence, when the drum 2 is rotated forward for forming the next image, the entire nip can face the roller 7A. As a result, the toner remaining on the drum 2 is entirely removed when it moves past the position of the roller 7A particular to the forward rotation.

While image formation using the drum 2 is not performed, the roller 7A is spaced from the drum 2. This condition also holds when the drum 2 is rotated in the reverse direction. Therefore, as shown in FIG. 31, the roller 7A contacts the drum 2 before the biases are turned on (ON) at the beginning of the forward rotation of the drum 2. It follows that when the drum 2 in a halt starts rotating forward, the roller 7A scrapes off the toner remaining at the nip.

As also shown in FIG. 31, the roller 7A is separated from the drum 2 on the elapse of a predetermined period of time T after the image formation during which the drum 2 is rotated forward. This allows the drum 2 to remain in a halt with substantially no toner remaining thereon. In addition, because the roller 7A is spaced from the drum 2, the surface of the drum 2 is free from transformation.

With the alcove relation between the roller 7A and the drum 2, the modification causes most of the toner remaining on the drum 2 to face the roller 7A and be removed thereby. In addition, because the roller 7A is spaced from the drum 2 while image formation is not under way, no toner will exist on the drum 2 when the drum 2 is rotated forward for the next image formation. Therefore, no toner is transferred from the drum 2 to the charge roller 3A at the time of the next image formation; otherwise, the toner would deposit on the roller 3A and prevent it from uniformly charging the drum 2.

A sixth embodiment of the present invention will be described which uses a reversal developing system. This embodiment eliminates the previously discussed problem particular to reversal development. Specifically, it is a common practice with reversal development to maintain a charger operative at all times because toner deposits on the non-charged portions of a photoconductive element. However, when charging and discharging are effected over the toner redeposited on the element between consecutive images as usual, the amount of charge of the toner further increases with the result that a difference surface potential occurs between the portion where the toner is present and the portion where it is absent. This, coupled with the increase in the amount of charge of the toner, makes it difficult to remove the toner from the element and collect it at a developing section.

Figure 32:
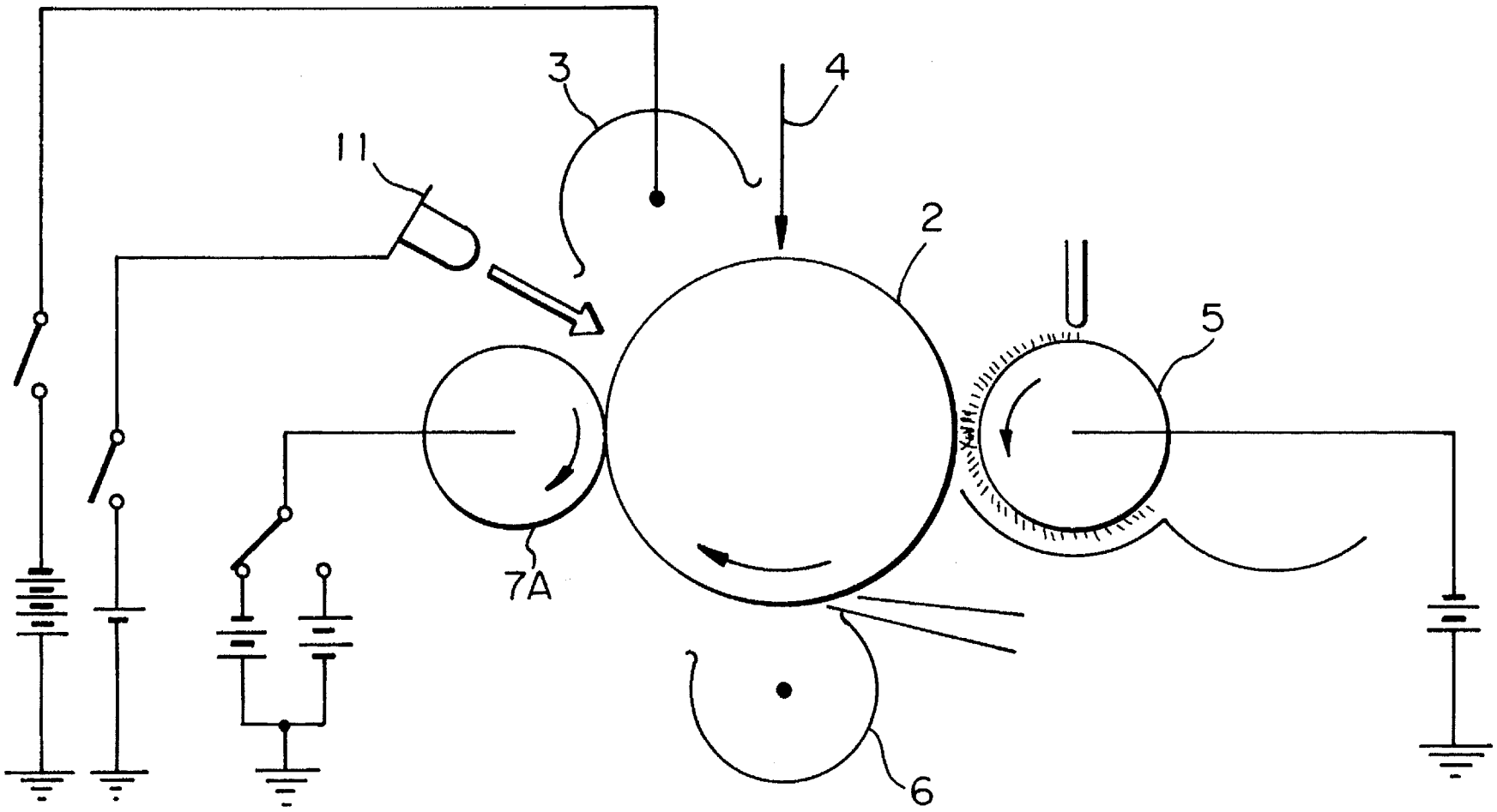
FIG. 32 is a section showing an alternative embodiment of the present invention.

As shown in FIG. 32, in the sixth embodiment, at first the drum 2 is uniformly charged to the same polarity as the toner by the charger 3 and then illuminated by the optics 4. The charger 3 is implemented by a corotron charger. As a result, a latent image is electrostatically formed on the drum 2. The latent image is developed by the developing device 5 to turn out a toner image. The toner image is transferred to a sheet by the image transferring device 6. The toner remaining on the drum 2 after the image transfer is once collected by the roller 7A, so that the drum 2 is cleaned. In the illustrative embodiment, the roller 7A is implemented by foam material having a medium resistance. When a voltage opposite in polarity to the toner is applied to the roller 7A, an electric field tending to attract the toner is formed between the roller 7A and the drum 2. Subsequently, the drum 1 is discharged by the discharge lamp 11. Then, the image forming cycle beginning with the charging step is repeated. When a single image forming cycle ends, a voltage of the same polarity as the toner and having a level causing the roller 7A to release the toner toward the drum 2, which has been uniformly charged by the charger, 3 is applied to the roller 7A. The toner redeposited on the drum 2 is routed through the discharge lamp 11 and charger 3 to the developing device 5 and collected by the device 5. At this instant, because the device 6, discharge lamp 11 and charger 3 are turned off, they do not effect the surface portion of the drum 2 carrying the toner thereon. Because the surface potential of the drum 2 is uniform and because the amount of charge of the toner does not increase, the cleaning ability available with the developing device 5 is enhanced.

Figure 33:
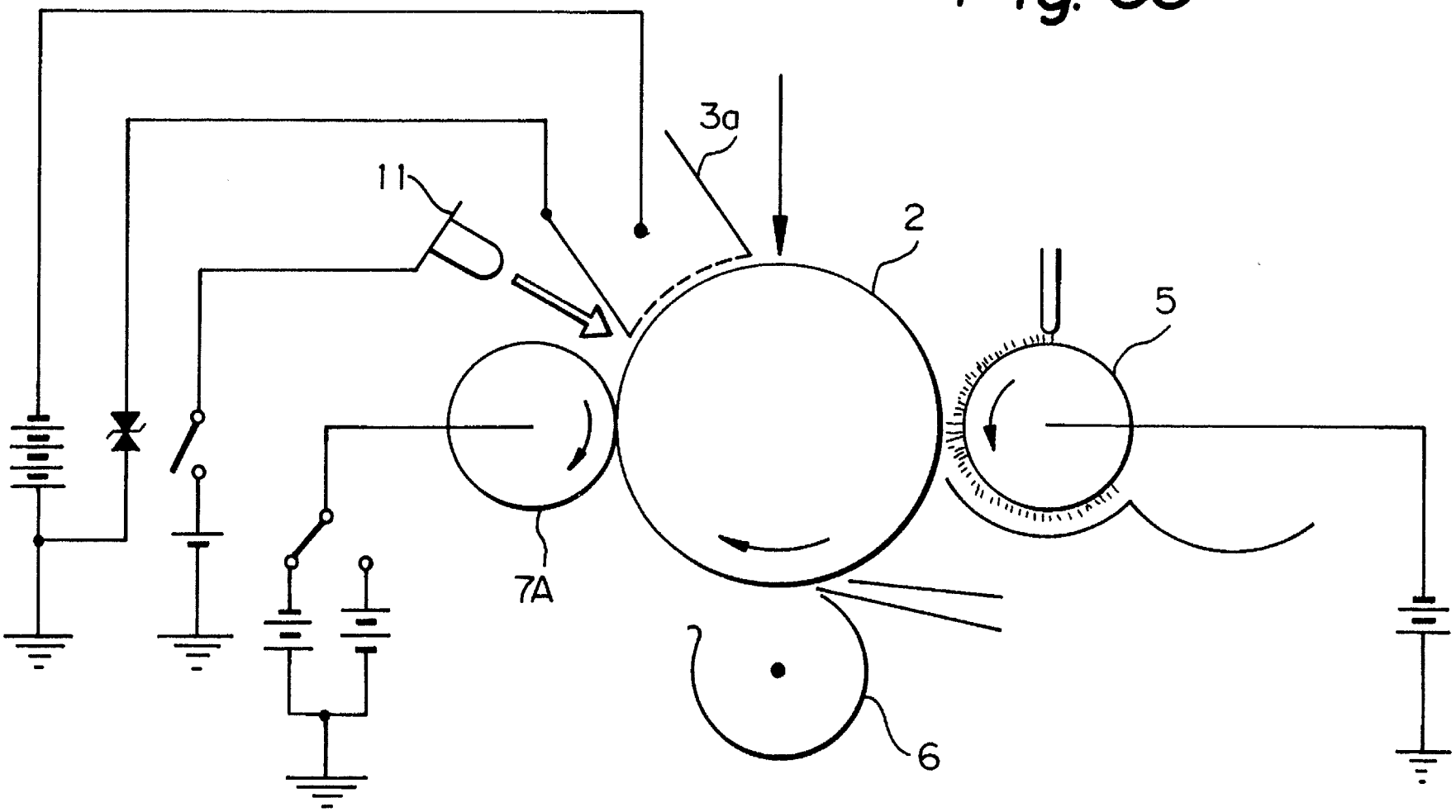
FIG. 33 is a section showing another alternative embodiment of the present invention.

However, the electric field tending to attract the toner from the drum 2 toward the charger 3 is apt to cause the toner to smear the charger 3. FIG. 33 shows specific control over the electric field and capable of obviating the above drawback. As shown, after toner has been transferred to a sheet by the same image forming process as in FIG. 32, the toner remaining on the drum 2 is once collected by the roller 7A. Subsequently, a voltage of the same polarity as the toner and having a level causing the roller 7A to release the toner toward the drum 2, which has been uniformly charged by a charger 3*a*, is applied to the roller 7A. At the same time, the discharge lamp 11 is turned off while the charger 3*a* is constantly operated. Because the surface of the drum 2, carrying the redeposited toner thereon, has been uniformly charged by the previous image forming cycle, it scarcely occurs that the surface of the drum 2 is further charged by the charger 3*a*. The charger 3*a* should preferably be implemented by a scorotron charger having a desirable potential control ability. When the surface of the drum 2 carrying the redeposited toner arrives at the charger 3*a*, the toner smears the charger 3*a* little because a voltage of the same polarity as the toner is applied to the charger 3*a*. The constructions and operations of the drum, developing device 5 and other constituents are the same as in FIG. 32 and will not be described specifically.

In summary, it will be seen that the present invention provides an image forming apparatus and a cleaning device therefor which have various unprecedented advantages, as enumerated below.

(1) During the course of recording, a cleaning roller is rotated together with an image carrier. The roller frictionally charges toner left on the image carrier after image transfer to the same polarity. A cleaning member electrostatically collects the charged toner. At the same time, a voltage is applied to the cleaning member by voltage applying means in order to cause it to attract the charged toner, thereby cleaning the image carrier. Hence, even when the toner remaining on the image carrier is charged partly to the positive polarity and partly to the negative polarity, the toner can be entirely transferred to the cleaning member by a simple construction.

(2) To reuse the toner deposited on the cleaning member, a voltage opposite in polarity to the above voltage is applied to the cleaning member by the voltage applying means. As a result, the toner is again deposited on the area of the image carrier other than the area where the next image is to be formed. The image carrier conveys the toner to a developing device to which a voltage capable of attracting the toner is applied. Hence, the toner is surely collected by the developing device.

(3) To reuse the toner deposited on the cleaning member, an image transferring device charges the surface of the image carrier. As a result the toner is again deposited on the area of the image carrier other than the area where the next image is to be formed. The image carrier conveys the toner to the developing device. The toner is collected in the developing device based on the polarity of the voltage applied to the device. This also allows the toner to be surely collected by the developing device.

(4) Even when a part of the toner retained by the cleaning member has been inverted to the polarity opposite to the polarity necessary for the deposition on the cleaning member, it can be retransferred to the image carrier due to a change in the direction of an electric field. Hence, all the toner left in the image area of the image carrier can be collected by the developing device and can be used again.

(5) The cleaning member is rotated in an amount controlled in matching relation to the length of the image area of the image carrier. It follows that the reverse transfer of the toner from the cleaning member to the image area of the image carrier is obviated without regard to the length of the image area. Hence, all the toner remaining in the image area can be collected.

(6) Even when the cleaning member is moved in the same direction as the image carrier, a critical hardness minimizing the wear of the image carrier is achieved as well as a critical pressure and rotation speed capable of charging the toner by friction most effectively. Hence, even if the nip between the cleaning member and the image carrier is reduced, the toner deposited on the cleaning member can be regulated to the same polarity. This allows the toner to be desirably transferred from the image area of the image carrier due to the bias applied to the cleaning member. It follows that the nip of the cleaning member can be reduced in order to miniaturize the entire apparatus including the cleaning member.

(7) The cleaning member is moved in the opposite direction to the image carrier in order to set up a condition necessary for the frictional charging of the toner. Hence, even if the nip is reduced, the toner to be collected by the cleaning member is easily regulated to the same polarity. This also reduces the nip required of the cleaning member and thereby scales down the apparatus including the cleaning member.

(8) The cleaning member is rotated in a greater amount when it releases the toner toward the image carrier than when it collects the toner. This causes the rotation start position of the cleaning member for toner collection to be sequentially shifted. Therefore, the cleaning member is prevented from facing the image carrier at a single position at all times. It follows that the cleaning member is free from local wear and preserves the expected cleaning ability.

(9) The intensity of the electric field can be adequately set by a plurality of voltage control means in matching relation to, e.g., the amount of toner collected by the cleaning roller. This allows the toner to be surely redeposited on the image carrier and then collected by the developing device. Hence, not only the toner removing ability is protected from deterioration, but also the life of the image carrier is prevented from being reduced.

(10) Voltage control means forms an electric field for causing the toner to move from the image carrier toward the cleaning roller. Subsequently, the toner is returned from the cleaning roller to the image carrier. At this instant, the toner is redeposited on the image carrier by voltage control means more intense than voltage control means assigned to image formation. Hence, even the toner deposited on the cleaning roller in a great amount after, e.g., the removal of a jamming sheet can be entirely returned to the image carrier and then collected by the developing device. Hence, not only the toner removing ability is protected from deterioration, but also the life of the image carrier is prevented from being reduced.

(11) Even when an unusual amount of toner is input, e.g., when a sheet of size A4 is used with a document of size A3, a great amount of toner deposited on the cleaning roller can be entirely redeposited on the image carrier and then collected by the developing device. Hence, not only the toner removing ability is protected from deterioration, but also the life of the image carrier is prevented from being reduced.

(12) Even when the image transfer ratio is lowered due to a thick sheet or a change in environment, the resulting great amount of toner can be entirely returned from the cleaning roller to the image carrier. Hence, not only the toner removing ability is protected from deterioration, but also the life of the image carrier is prevented from being reduced.

(13) The cleaning member is held in contact with the image carrier only when it collects the toner from the image carrier and when it redeposits it on the image carrier. This frees the cleaning member from deterioration and insures the collection of the toner from the image carrier over a long period of time.

(14) The cleaning member is moved away from the image carrier as soon as the redeposition of the toner on the image carrier ends. The image carrier is, therefore, free from the influence of the cleaning member. In addition, when the toner is left on the cleaning roller, it is prevented from being depositing on the image carrier. This protects the background of the image carrier from contamination and thereby obviates defective images.

(15) The image carrier starts ordinary image formation only after the cleaning member has collected the toner and then released it onto the image carrier. Hence, initialization for collecting the entire toner from the image carrier is practicable and fully eliminates the background contamination of an image area and other defects.

(16) Just after the start of the image carrier, the cleaning member contacts it over a longer period of time than usual. Hence, there can be used a bias voltage assigned to usual cleaning. Consequently, the electrostatic fatigue which would reduce the life of the image carrier is reduced.

(17) When the cleaning member is in contact with the image carrier, the charging device is spaced from the image carrier. This prevents the toner redeposited on the image carrier from being transferred to the charging device; otherwise, the toner would obstruct uniform charging and result in defective images.

(18) While image formation using the image carrier is not under way, inclusive of the interruption of image formation, the cleaning member is spaced from the image carrier. This prevents the toner removing ability from being lowered by the transformation of the surface of the image carrier and the deterioration of the function of the cleaning member. Should the ability be lowered by this kind of causes, white stripes due to the local omission of an image would appear on the restart of image formation, and the toner would deposit on the charging member and obstruct uniform charging.

(19) Before the image carrier contacts the cleaning member, it is rotated in the direction opposite to the direction assigned to image formation and moved more than the nip width. Hence, at the time of image formation when the cleaning member contacts the image carrier, the toner remaining on the image carrier at the nip surely moves past the cleaning member. The toner can, therefore, be surely removed before the charging step.

(20) The rotation of the cleaning roller and the application of the voltage begin before image forming using the image carrier. Hence, when the image carrier starts rotating for image formation, the cleaning member is ready to remove the toner. This prevents the toner from depositing on a contact member which performs charging at the time of image formation, thereby guaranteeing uniform charging.

(21) Because the polarity of the surface potential of the image carrier is corrected to one which can be dissipated at the discharging step, uniform charging for the next image is insured and prevents the image quality from being lowered.

(22) Assume that the toner is present on the surface of the image transferring device. Then, when the redeposition area of the image carrier faces the device, the toner is transferred to the redeposition area due to the switchover of the direction of the electric field. Hence, the toner is prevented from being transferred to the rear of the next sheet and contaminating it.

(23) The cleaning member collects all the toner from the image area of the image carrier while it makes one rotation.

Hence, the toner deposited on the cleaning member is prevented from facing the trailing edge of the image area; otherwise, the transfer bias remaining in the image area would cause the reverse transfer of the toner from the cleaning member to the image area of the image carrier.

Various modifications will become possible for those skilled in the art after receiving the teachings of the present disclosure without departing from the scope thereof. For example, in FIG. 3, at the time of redeposition, a negative bias voltage is applied to the cleaning roller 7A. Alternatively, a positive bias voltage may be applied to the transfer roller 6 so as to charge the drum 2. This will also retransfer the toner from the roller 7A to the drum 2. The roller 7A may be implemented by an elastic foam body having a bubble diameter of less than 50 μm at the surface, which diameter is smaller than in the inside of the roller. With this configuration, the roller 7A will prevent the toner from penetrating thereinto in the event of cleaning. The drum 2 may, of course, be replaced with a photoconductive belt. The image carrier may be applied to a color copier and may be implemented as an intermediate transfer belt or similar intermediate transfer body. Further, while the embodiments change the direction of the electric field by switching the polarity of the bias voltage to the roller 7A, the direction may be switched by setting a particular polarity and surface potential for the image carrier while maintaining the polarity of the bias potential constant; the image transfer device may be used to set such a polarity and surface potential.

What is claimed is:

1. An image forming apparatus having a function of removing residual toner remaining on an image carrier after image transfer and collecting said toner, said apparatus comprising:

a developing device for developing a latent image electrostatically formed on said image carrier to thereby produce a corresponding toner image;

an image transferring device for transferring the toner image to a recording medium; and a cleaning device for applying, during a single image forming process using said image carrier, an electric field in one direction in order to attract and retain the residual toner, and then switching the direction of said electric field in order to redeposit said toner in an area of said image carrier which does not effect the next image formation, said image carrier conveying said toner to said developing device, whereby said toner is electrostatically collected by said developing device;

said cleaning device comprising a cleaning member contacting said image carrier and movable together with said image carrier, and for rubbing the residual toner at a nip between said cleaning member and said image carrier to thereby charge said toner to a same polarity and electrostatically attract said toner, and voltage applying means for applying a voltage to said cleaning member.

2. An apparatus as claimed in claim 1, wherein at said nip said image carrier and said cleaning member are moved in opposite directions to each other at different peripheral speeds from each other.

3. An apparatus as claimed in claim 1, wherein said cleaning member comprises a rotatable conductive cleaning roller.

4. An apparatus as claimed in claim 3, wherein when the toner deposited on said cleaning roller is to be reused, said voltage applying means applies a voltage opposite in direction to the voltage applied for attraction to thereby redeposit said toner in an area of said image carrier other than an area for forming the next image, and wherein said developing device comprises a voltage applying means for applying a voltage of a polarity capable of attracting said toner redeposited on said image carrier.

5. An apparatus as claimed in claim 4, wherein said image transferring device comprises voltage applying means for applying, when the toner deposited on said cleaning roller is to be reused, a voltage opposite in direction to the voltage applied for the attraction of said cleaning roller to said image carrier to thereby charge a surface of said image carrier and redeposit said toner in said area of said image carrier, and wherein said voltage applying means of said developing device applies to said developing device a voltage of a polarity capable of attracting said toner redeposited on said image carrier.

6. An apparatus as claimed in claim 3, wherein said cleaning roller makes at least two rotations, starting at a trailing edge of an image forming area of said image carrier, when said cleaning roller faces an area of said image carrier which does not effect the next image forming area, and wherein an electric field is formed in a particular direction for each of said two rotations.

7. An apparatus as claimed in claim 6, wherein when said image transferring device faces said area of said image carrier where the toner is to be redeposited, an electric field formed by said image transferring device is switched in the same manner as the electric field formed by said cleaning roller.

8. An apparatus as claimed in claim 6, further comprising discharging device for discharging the surface of said image carrier, wherein after the toner has been redeposited on said image carrier, said developing device located upstream of said discharging device in a direction of movement of said image carrier deposits on said image carrier a charge capable of being dissipated by said discharging device.

9. An apparatus as claimed in claim 6, wherein said cleaning device further comprises a plurality of voltage control means for each applying a voltage capable of transferring the toner from said cleaning roller toward said image carrier, and wherein said plurality of voltage control means are different from each other in an intensity of an electric field causing said toner to move from said cleaning roller to said image carrier.

10. An apparatus as claimed in claim 7, wherein to remove the toner from said image carrier just after said apparatus has been switched on or during warm-up of said apparatus, voltage control means capable of forming an electric field for causing said toner to move from said image carrier toward said cleaning roller is caused to operate, and then one of said plurality of voltage control means is operated to redeposit said toner of said cleaning roller on said image carrier and forms an electric field more intense than an electric field to be formed by another of said plurality of voltage control means during image formation.

11. An apparatus as claimed in claim 9, wherein on the elapse of a predetermined period of time after a stop of image formation, one of said plurality of voltage control means causes the toner of said cleaning member to be redeposited on said image carrier and forms an electric field more intense than an electric field to be formed by another of said plurality of voltage control means during image formation.

12. An apparatus as claimed in claim 9, wherein once for every predetermined number of images produced, one of said plurality of voltage control means causes the toner of said cleaning roller to be redeposited on said image carrier by forming an electric field different from a usual electric field.

13. An apparatus as claimed in claim 3, wherein in the event of redeposition of the toner on said image carrier, an electric field for causing said cleaning roller to attract said toner from said image carrier is formed first, and then an electric field for causing said cleaning roller to release said toner toward said image carrier is formed.

14. An apparatus as claimed in claim 13, wherein a voltage for forming the electric field to be formed first has a polarity opposite to a polarity of charge to be deposited on the toner by friction acting between said cleaning roller and said image carrier, and is higher than a voltage used to attract said toner from said image carrier.

15. An apparatus as claimed in claim 3, wherein said cleaning roller is rotated in an amount capable of attracting the toner from an area of said image carrier corresponding to a maximum image area as measured in a direction of movement of said image carrier.

16. An apparatus as claimed in claim 15, wherein said cleaning roller attracts in an area thereof smaller than a circumferential length the toner remaining in a part of the image area of said image carrier corresponding to said area, as measured in a direction of movement of said image carrier.

17. An apparatus as claimed in claim 3, wherein said cleaning roller is rotated in an amount variable in accordance with a length of an image forming area of said image carrier.

18. An apparatus as claimed in claim 3, wherein said cleaning roller is formed of rubber having a hardness of 20 degrees to 38 degrees in terms of ASCA C, and exerts a pressure of higher than 3 $g/cm^2$ on said image carrier, and moves in a same direction as said image carrier with a linear speed ratio of less than 1 to said image carrier.

19. An apparatus as claimed in claim 3, wherein said cleaning roller is formed of rubber having a hardness of 20 degrees to 38 degrees in terms of ASCA C, and exerts a pressure of higher than 3 $g/cm^2$ on said image career, and moves in a direction opposite to a direction of movement of said image carrier.

20. An apparatus as claimed in claim 3, wherein said cleaning roller is rotated in a greater amount at the time of redeposition of the toner on said image carrier than at the time of attraction of said toner.

21. An apparatus as claimed in claim 3, further comprising moving means for holding said cleaning roller in contact with said image carrier until an end of attraction and redeposition of the toner, and moves said cleaning roller away from said image carrier after the end of said redeposition.

22. An apparatus as claimed in claim 21, wherein said moving means moves said cleaning roller into contact with said image carrier when said cleaning roller attracts the toner from said image carrier when applied with an electric field acting in one direction.

23. An apparatus as claimed in claim 21, wherein said moving means moves said cleaning roller out of contact with said image carrier simultaneously with an end of the redeposition caused by an electric field applied to said cleaning member and acting in the other direction.

24. An apparatus as claimed in claim 21, wherein said image carrier starts, after a start-up, moving for image formation after said moving means has moved said cleaning roller into and out of contact with said image carrier at least once.

25. An apparatus as claimed in claim 21, wherein just after a start-up of said image carrier, said moving means holds said cleaning roller in contact with said image carrier for a longer period of time than during usual image formation.

26. An apparatus as claimed in claim 3, further comprising a charging device for charging a surface of said image carrier, and a discharging device for discharging said surface.

27. An apparatus as claimed in claim 26, wherein said image carrier, said charging device and said discharging device are constructed into a single process cartridge.

28. An apparatus as claimed in claim 26, wherein said image carrier, said charging device, said discharging device, said cleaning device and said developing device are constructed into a single process cartridge.

29. An apparatus as claimed in claim 26, wherein said charging device is movable into and out of contact with said image carrier, and wherein said cleaning device further comprises moving means supporting said cleaning roller such that said cleaning roller is movable toward and away from said image carrier.

30. An apparatus as claimed in claim 29, wherein said charging device is spaced from said image carrier until said moving means moves said cleaning roller away from said image carrier.

31. An apparatus as claimed in claim 30, wherein said moving means moves said cleaning roller away from said image carrier when image formation is not executed on said image carrier.

32. An apparatus as claimed in claim 31, wherein before said cleaning roller contacts said image carrier, said image carrier is moved in a direction opposite to a direction assigned to image formation.

33. An apparatus as claimed in claim 32, wherein an amount in which said image carrier is moved in the opposite direction is greater than a nip width formed between said cleaning roller and said image carrier in a direction of movement of said image carrier.

34. An apparatus as claimed in claim 31, wherein a rotation of said cleaning roller and an application of the voltage by said voltage applying means in said cleaning device begin before image forming using said image carrier begins.

35. An apparatus as claimed in claim 31, wherein said cleaning roller is moved away from said image carrier on the elapse of a predetermined period of time after a stop of image formation.

* * * * *